US010204546B2

(12) United States Patent
Kim et al.

(10) Patent No.: US 10,204,546 B2
(45) Date of Patent: Feb. 12, 2019

(54) DISPLAY DEVICE

(71) Applicant: Samsung Display Co., Ltd., Yongin-si (KR)

(72) Inventors: Sungman Kim, Seoul (KR); Junho Song, Seongnam-si (KR); Seongsu Lim, Seoul (KR); Taehyung Hwang, Seoul (KR)

(73) Assignee: Samsung Display Co., Ltd., Yongin-si (KR)

( * ) Notice: Subject to any disclaimer, the term of this patent is extended or adjusted under 35 U.S.C. 154(b) by 63 days.

(21) Appl. No.: 15/401,638

(22) Filed: Jan. 9, 2017

(65) Prior Publication Data

US 2017/0345359 A1 Nov. 30, 2017

(30) Foreign Application Priority Data

May 25, 2016 (KR) ..... 10-2016-0064130

(51) Int. Cl.
*G09G 3/20* (2006.01)
*G09G 3/36* (2006.01)

(52) U.S. Cl.
CPC ..... *G09G 3/2092* (2013.01); *G09G 3/2003* (2013.01); *G09G 3/3607* (2013.01); *G09G 3/3614* (2013.01); *G09G 2300/0426* (2013.01); *G09G 2300/0452* (2013.01); *G09G 2320/0247* (2013.01); *G09G 2320/0666* (2013.01)

(58) Field of Classification Search
CPC ..... G09G 3/2092; G09G 3/2003; G09G 2320/0666; G09G 3/3607; G09G 3/3614; G09G 2300/0426; G09G 2300/0452; G09G 2320/0247
See application file for complete search history.

(56) References Cited

U.S. PATENT DOCUMENTS

2011/0156992 A1* 6/2011 Moon ..... G09G 3/3607 345/84
2012/0194573 A1 8/2012 Yamashita et al.
2015/0138464 A1 5/2015 Okazaki et al.
2015/0332643 A1 11/2015 Higashi et al.
2015/0364104 A1 12/2015 Hwang et al.

FOREIGN PATENT DOCUMENTS

KR 10-2008-0101263 11/2008
KR 10-2012-0068942 6/2012
KR 10-2015-0144897 12/2015

* cited by examiner

*Primary Examiner* — Richard Hong
(74) *Attorney, Agent, or Firm* — H.C. Park & Associates, PLC

(57) ABSTRACT

A display device includes a first pixel group having first, second, third, and fourth pixels arranged along a column direction, and a second pixel group having fifth, sixth, seventh, and eighth pixels arranged along the column direction. A gate line is connected to the first, second, third, fourth, fifth, sixth, seventh, and eighth pixels. A first data line is connected to the first pixel, the third pixel, the fourth pixel, and the sixth pixel, and a second data line is connected to the second pixel, the fifth pixel, the seventh pixel, and the eighth pixel. The first pixel group and the second pixel group are alternately disposed along a row direction. This arrangement allows inversion driving wherein the first data line receives a voltage having a different polarity from that of the second data line so as to reduce line flickering and reduce power consumption in the display device.

22 Claims, 22 Drawing Sheets

BLUE

RED

GREEN

WHITE

MAGENTA

YELLOW

WHITE

DISPLAY DEVICE

CROSS-REFERENCE TO RELATED APPLICATION

This application claims priority from and the benefit of Korean Patent Application No. 10-2016-0064130, filed on May 25, 2016, which is hereby incorporated by reference for all purposes as if fully set forth herein.

BACKGROUND

1. Field

Exemplary embodiments relate to a display device, and more particularly, to a display device capable of significantly reducing line flickering.

2. Discussion of the Background

In general, liquid crystal materials included in a liquid crystal display ("LCD") device have an issue of deteriorating as a result of constant application of an electric field having the same polarity. In order to prevent the deterioration of the liquid crystal materials, a polarity of a pixel voltage corresponding to a common voltage is inverted when operating the LCD device. That is, when a signal voltage of a positive polarity is stored in a single pixel in a current frame, a signal voltage of a negative polarity should be stored therein in a succeeding frame.

For these reasons, in order to perform inversion driving of an LCD device, exemplary methods used in the art include a frame inversion method, a line inversion method, a column inversion method, and a dot inversion method.

These inversion driving methods rely upon human eyes simultaneously recognizing multiple pixels from a predetermined distance and thus, each of pixels in a predetermined area has a certain average luminance value. Such an inversion driving method is valid in a general display environment such that users may not feel uncomfortableness, but when displaying patterns corresponding to the inversion driving method, flickering may still occur.

The flickering, an image quality characteristic, occurs when a storage polarity of liquid crystals is periodically inversed between a positive polarity (+) and a negative polarity (−) and there is a transmittance difference between the two polarities. This flickering occurs because each of the dots is dispersed on a plane and voltage to control each dot is only applied in one direction to cause an RC delay based on a length of an LCD panel such that the same voltage may not be applied to each of the dots.

For example, when column inversion driving is performed, an issue of vertical line-shaped flickering may occur due to a difference between respective effective voltages of two adjacent columns in which a polarity is inversed.

In addition, for example, in a case where an RGBW pixel is disposed in a stripe pattern, e.g., R, G, B, W, R, G, B, and W, in a single column, when a column inversion driving is performed, based on a connection relationship among data lines, the polarity of the RGBW pixel may be +, −, +, −, +, −, +, and −, in order. In such an example, in the case of a pixel R in a first pixel column, a first polarity is a positive polarity and a second polarity is a positive polarity as well, and in the case of a pixel R in a second pixel column, a first polarity is a negative polarity and a second polarity is a negative polarity as well. Accordingly, line flickering occurs in each pixel column.

The above information disclosed in this Background section is only for enhancement of understanding of the background of the inventive concept, and, therefore, it may contain information that does not form the prior art that is already known in this country to a person of ordinary skill in the art.

SUMMARY

Exemplary embodiments provide a display device capable of significantly reducing line flickering.

Additional aspects will be set forth in the detailed description which follows, and, in part, will be apparent from the disclosure, or may be learned by practice of the inventive concept.

An exemplary embodiment discloses a display device including: a first pixel group comprising first, second, third, and fourth pixels arranged along a column direction; a second pixel group comprising fifth, sixth, seventh, and eighth pixels arranged along the column direction; a gate line connected to the first, second, third, fourth, fifth, sixth, seventh, and eighth pixels; a first data line connected to the first pixel, the third pixel, the fourth pixel, and the sixth pixel; and a second data line connected to the second pixel, the fifth pixel, the seventh pixel, and the eighth pixel. The first pixel group and the second pixel group are alternately disposed along a row direction.

An exemplary embodiment discloses a display device including: a first pixel group comprising first, second, third, and fourth pixels arranged along a column direction; a second pixel group comprising fifth, sixth, seventh, and eighth pixels arranged along the column direction; a gate line connected to the first, second, third, fourth, fifth, sixth, seventh, and eighth pixels; a first data line connected to the second pixel, the third pixel, the fifth pixel, and the eighth pixel; and a second data line connected to the first pixel, the fourth pixel, the sixth pixel, and the seventh pixel. The first pixel group and the second pixel group are alternately disposed along a row direction.

An exemplary embodiment discloses a display device including: a first pixel group comprising first, second, third, and fourth pixels arranged along a column direction; a second pixel group comprising fifth, sixth, seventh, and eighth pixels arranged along the column direction; a gate line connected to the first, second, third, fourth, fifth, sixth, seventh, and eighth pixels; a first data line connected to the first pixel, the second pixel, the fourth pixel, and the seventh pixel; and a second data line connected to the third pixel, the fifth pixel, the sixth pixel, and the eighth pixel. The first pixel group and the second pixel group are alternately disposed along a row direction.

The foregoing general description and the following detailed description are exemplary and explanatory and are intended to provide further explanation of the claimed subject matter.

BRIEF DESCRIPTION OF THE DRAWINGS

The accompanying drawings, which are included to provide a further understanding of the inventive concept, and are incorporated in and constitute a part of this specification, illustrate exemplary embodiments of the inventive concept, and, together with the description, serve to explain principles of the inventive concept.

DETAILED DESCRIPTION OF THE ILLUSTRATED EMBODIMENTS

Figure 1:
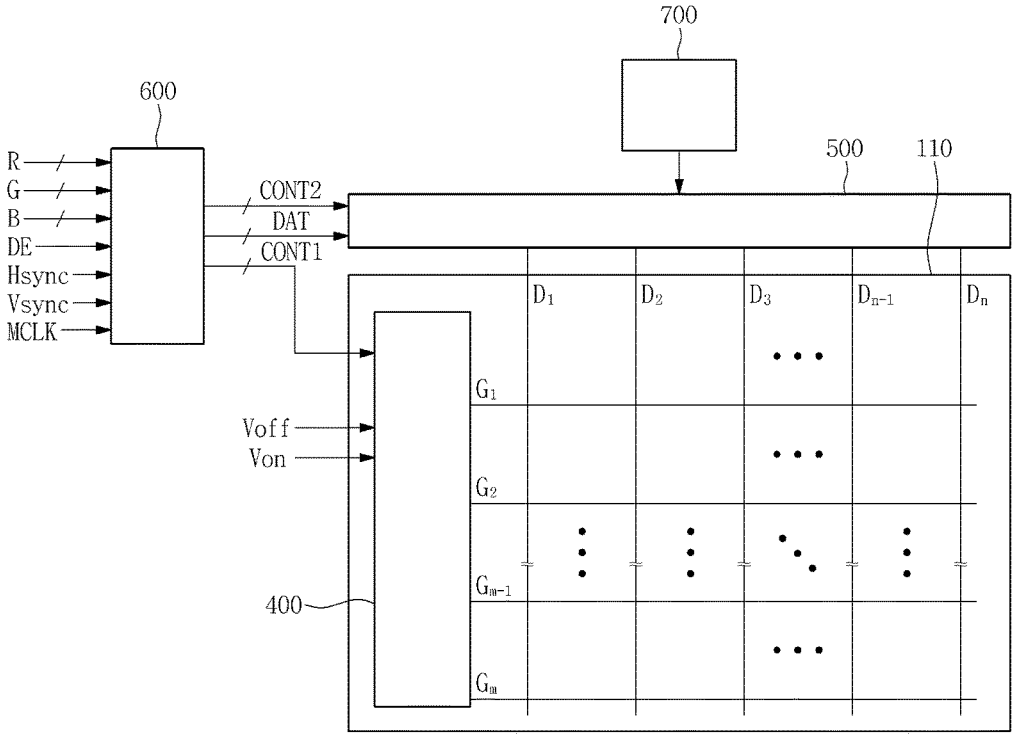
FIG. 1 is a block diagram illustrating an exemplary embodiment of a display device.

In the following description, for the purposes of explanation, numerous specific details are set forth in order to provide a thorough understanding of various exemplary embodiments. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments.

In the accompanying figures, the size and relative sizes of layers, films, panels, regions, etc., may be exaggerated for clarity and descriptive purposes. Also, like reference numerals denote like elements.

When an element or layer is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. Like numbers refer to like elements throughout. As used herein, the term "and/or" includes any and all combinations of one or more of the associated listed items.

Although the terms first, second, etc. may be used herein to describe various elements, components, regions, layers, and/or sections, these elements, components, regions, layers, and/or sections should not be limited by these terms. These terms are used to distinguish one element, component, region, layer, and/or section from another element, component, region, layer, and/or section. Thus, a first element, component, region, layer, and/or section discussed below could be termed a second element, component, region, layer, and/or section without departing from the teachings of the present disclosure.

Spatially relative terms, such as "beneath," "below," "lower," "above," "upper," and the like, may be used herein for descriptive purposes, and, thereby, to describe one element or feature's relationship to another element(s) or feature(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof.

Various exemplary embodiments are described herein with reference to sectional illustrations that are schematic illustrations of idealized exemplary embodiments and/or intermediate structures. As such, variations from the shapes of the illustrations as a result, for example, of manufacturing techniques and/or tolerances, are to be expected. Thus, exemplary embodiments disclosed herein should not be construed as limited to the particular illustrated shapes of regions, but are to include deviations in shapes that result from, for instance, manufacturing. The regions illustrated in the drawings are schematic in nature and their shapes are not intended to illustrate the actual shape of a region of a device and are not intended to be limiting.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and will not be interpreted in an idealized or overly formal sense, unless expressly so defined herein.

Figure 2:
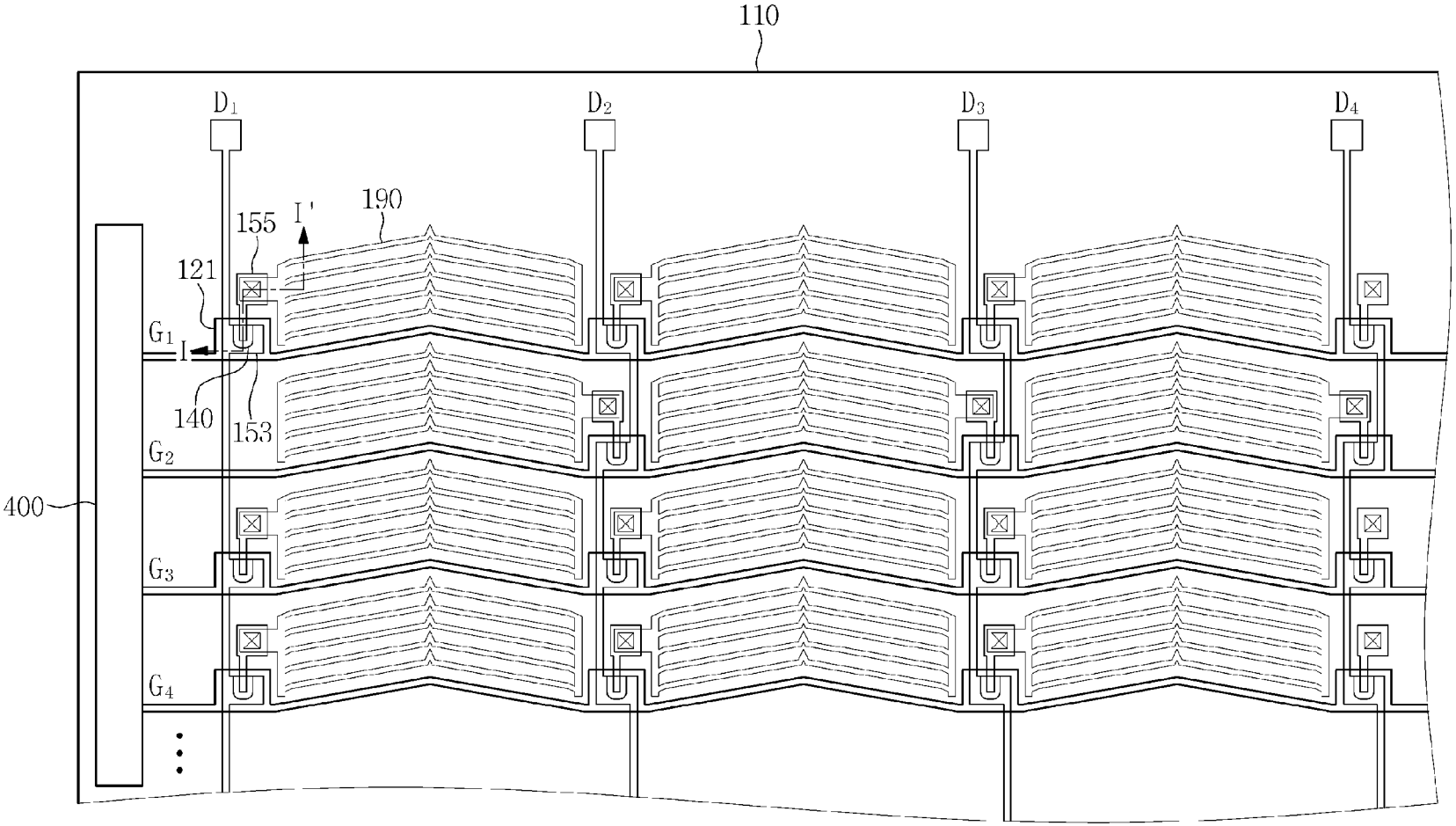
FIG. 2 is a plan view illustrating an exemplary embodiment of a display device.
Figure 3:
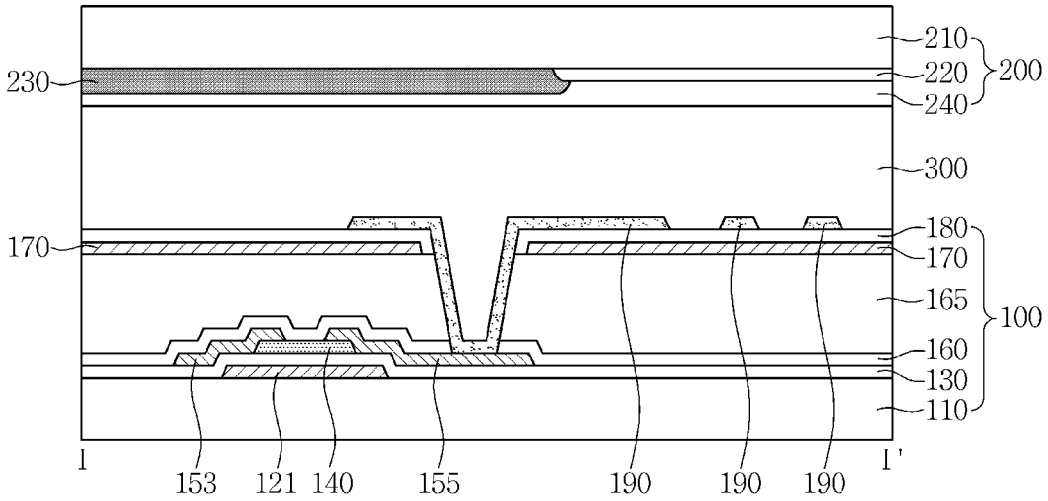
FIG. 3 is a cross-sectional view taken along line I-I' of FIG. 2.
Figure 4A:
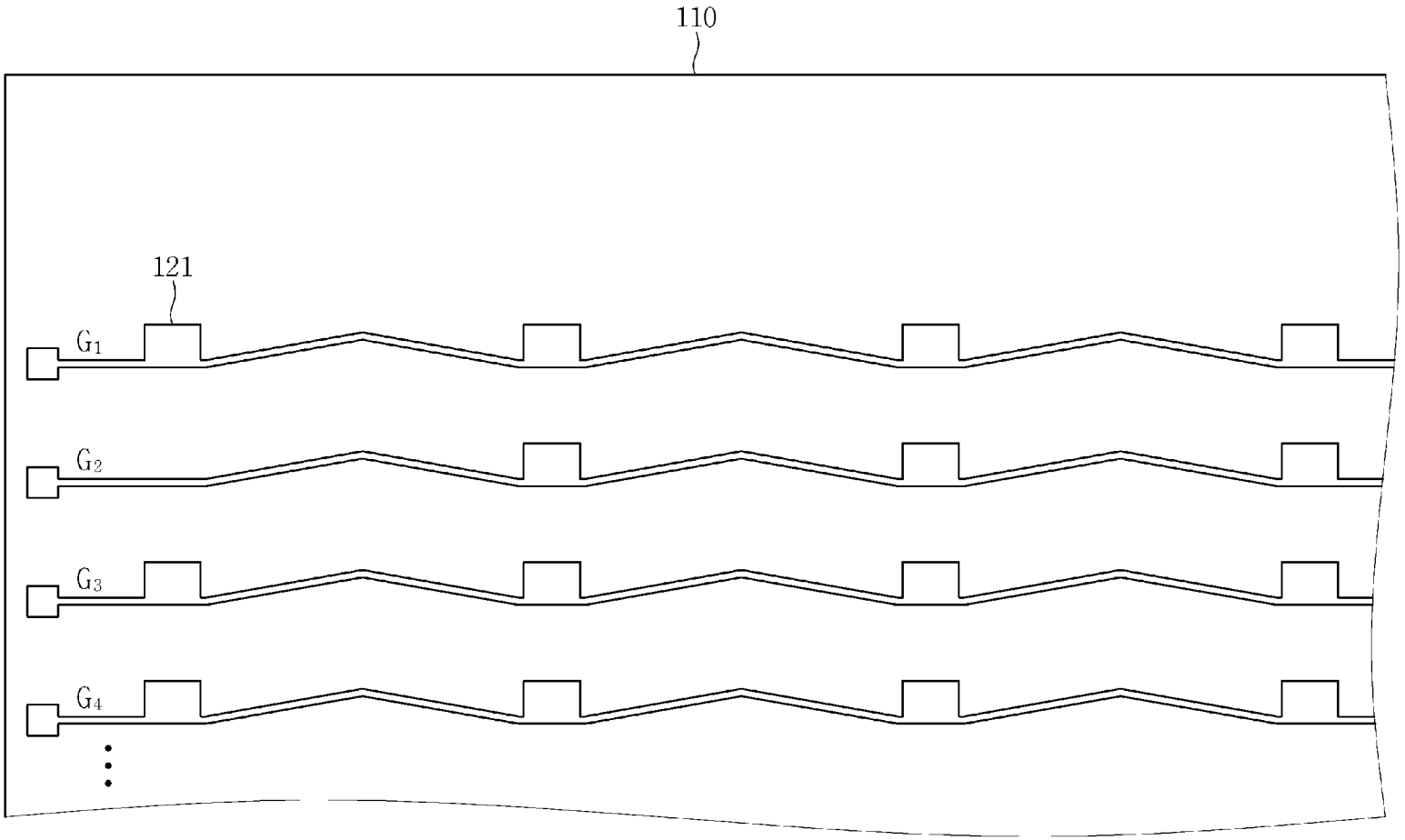
FIG. 4A, FIG. 4B, FIG. 4C, FIG. 4D, and FIG. 4E are plan views illustrating a method of manufacturing an exemplary embodiment of a display device.
Figure 4B:
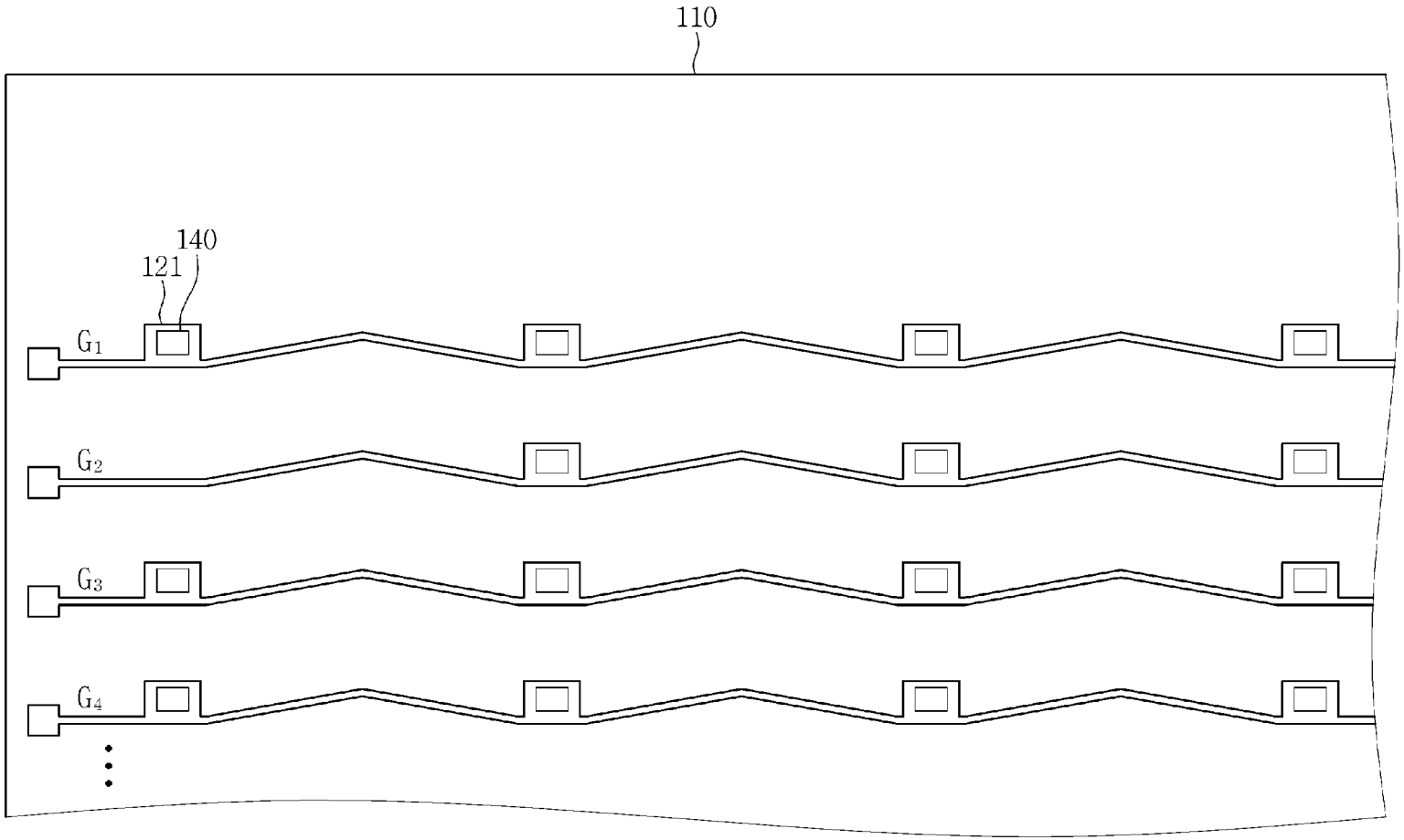
Figure 4C:
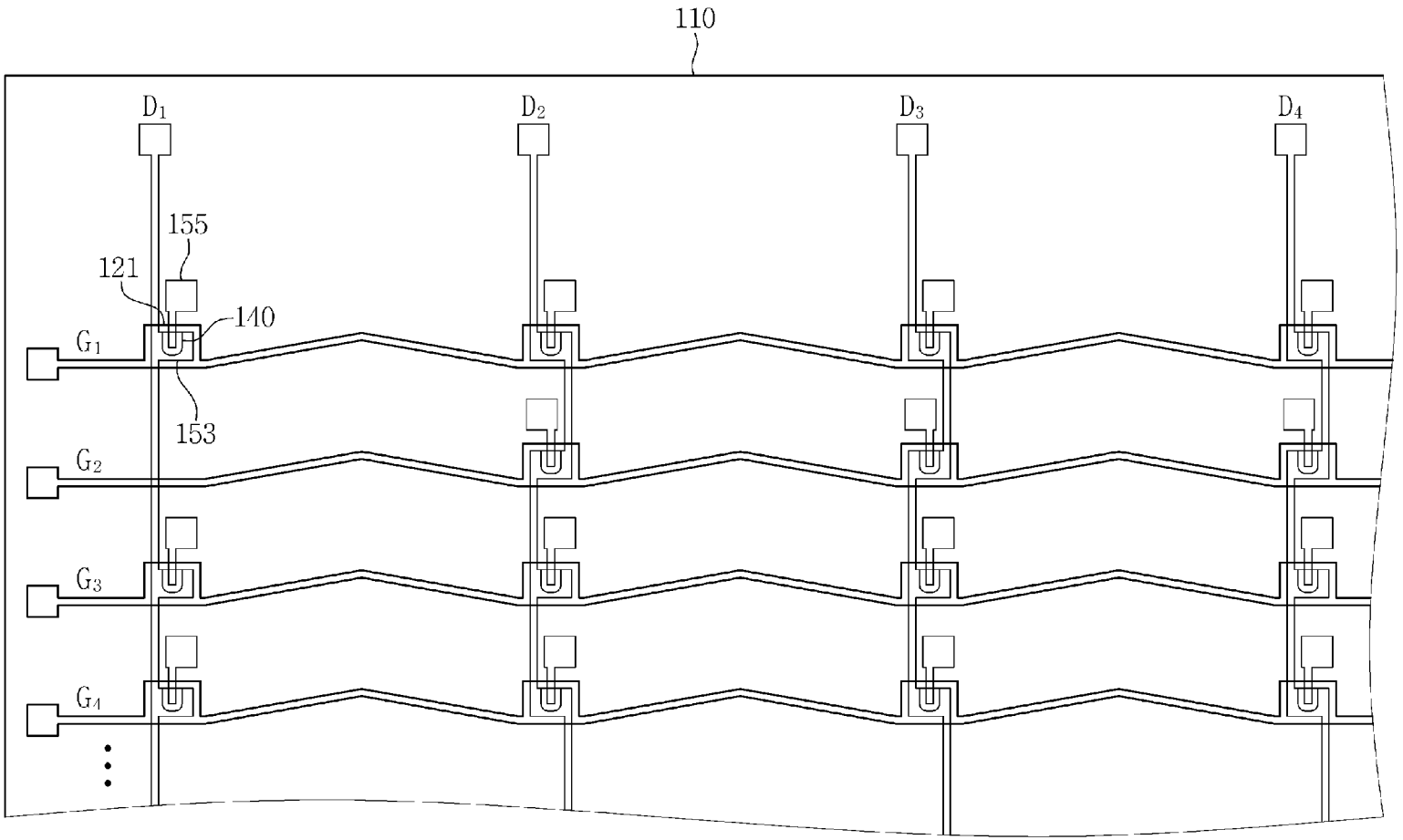
Figure 4D:
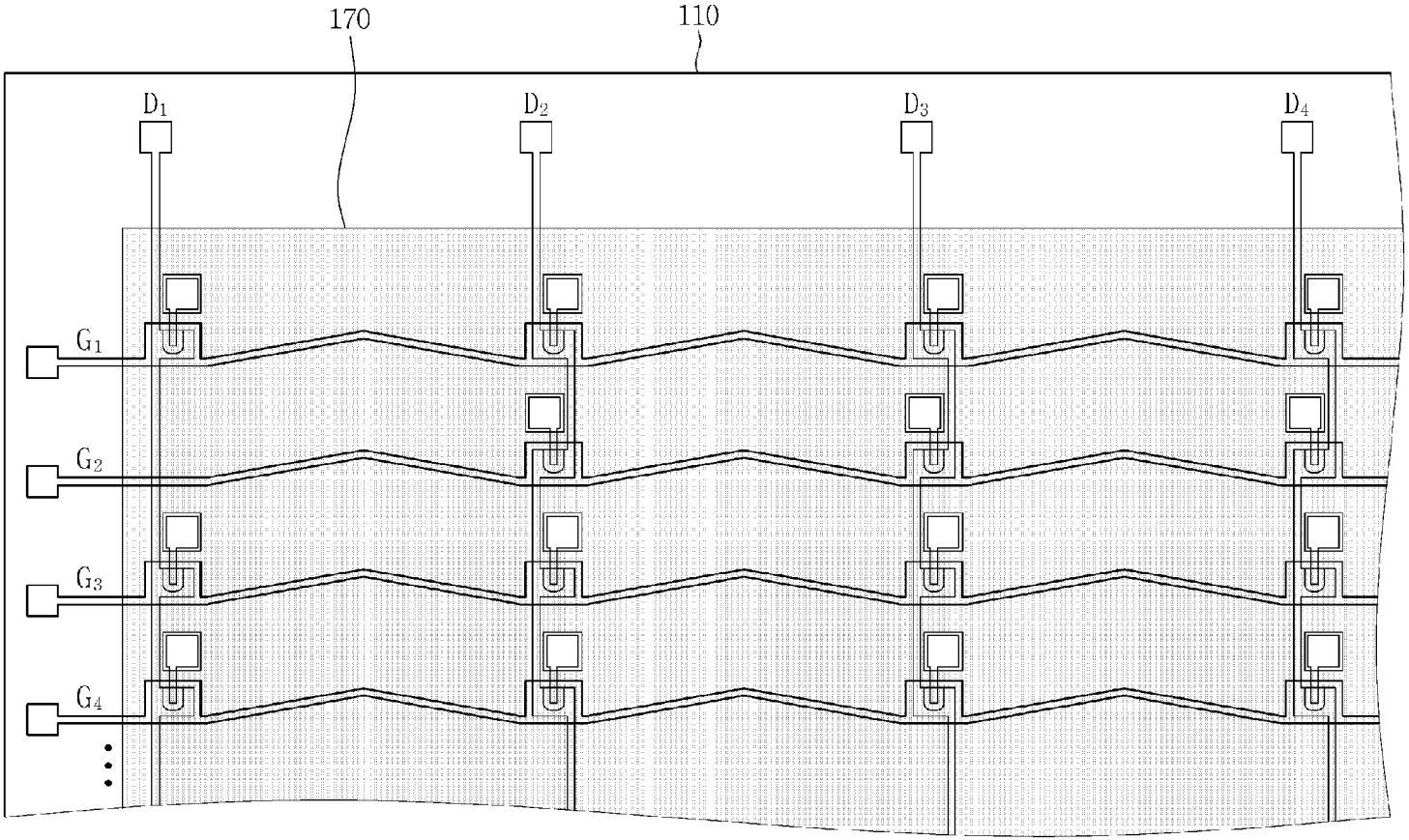
Figure 4E:
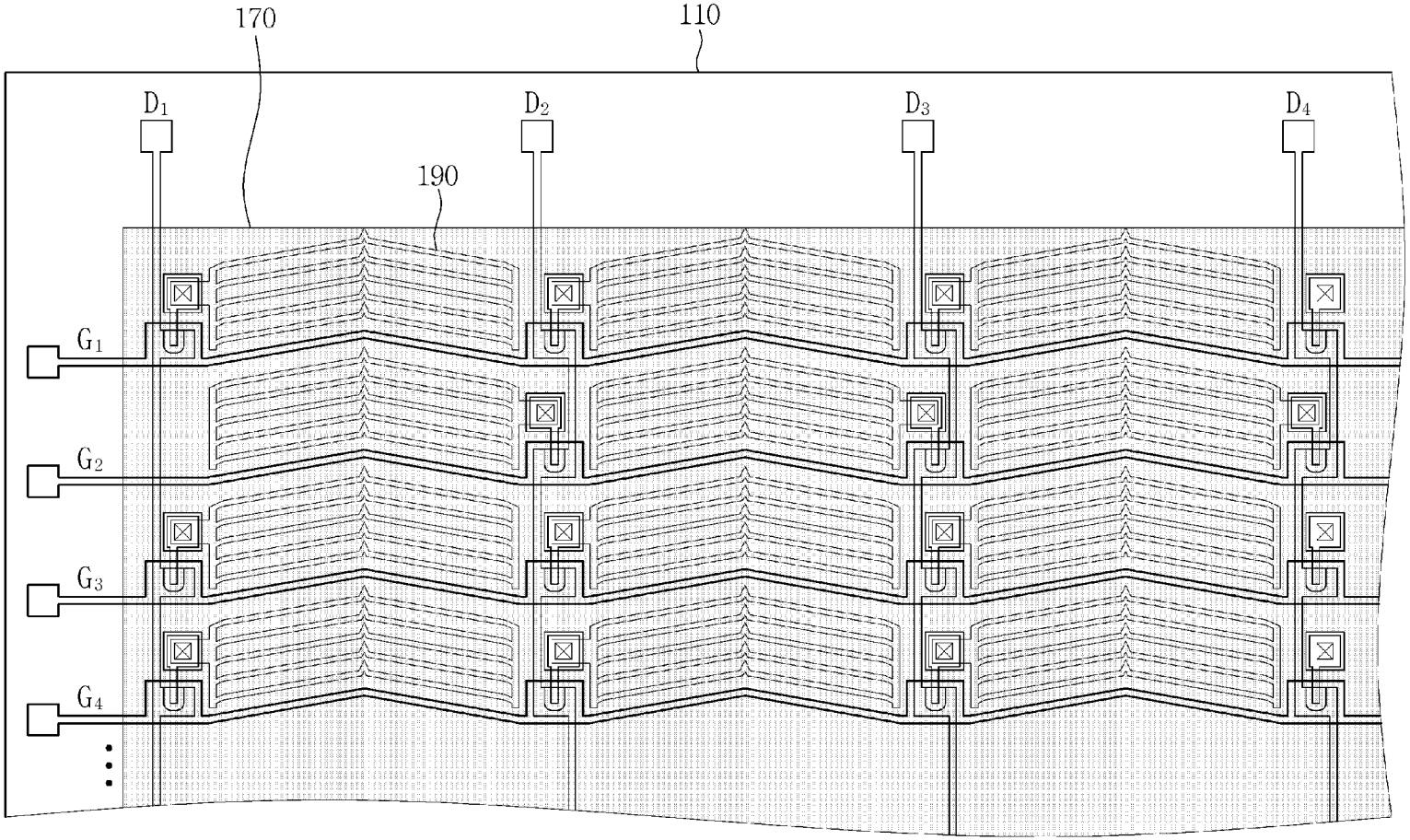
Figure 5A:
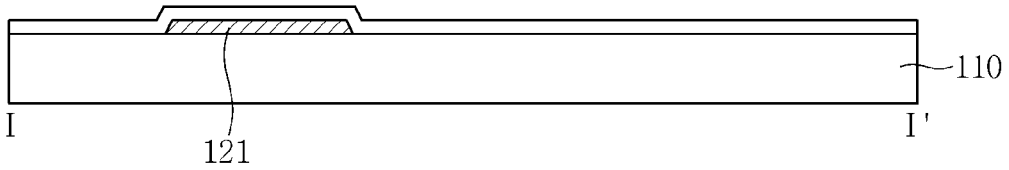
FIG. 5A, FIG. 5B, FIG. 5C, FIG. 5D, and FIG. 5E are cross-sectional views illustrating the method of manufacturing an exemplary embodiment of a display device.
Figure 5B:
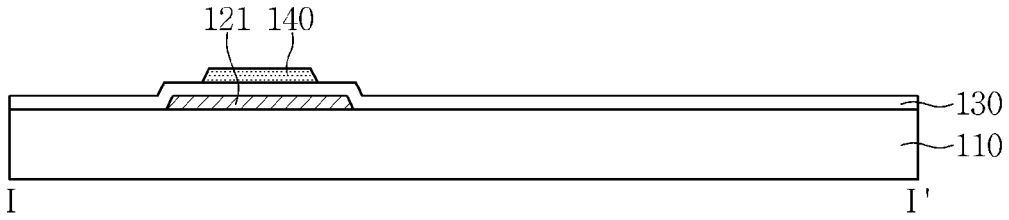
Figure 5C:
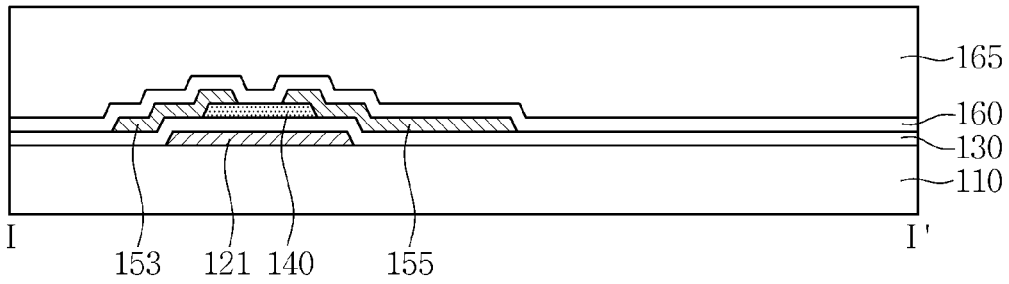
Figure 5D:
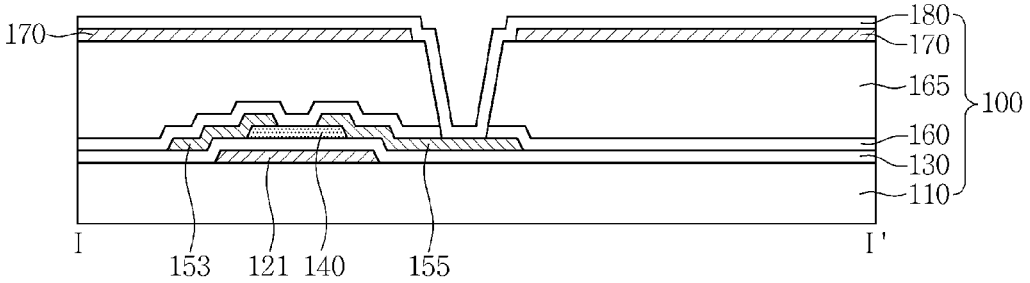
Figure 5E:
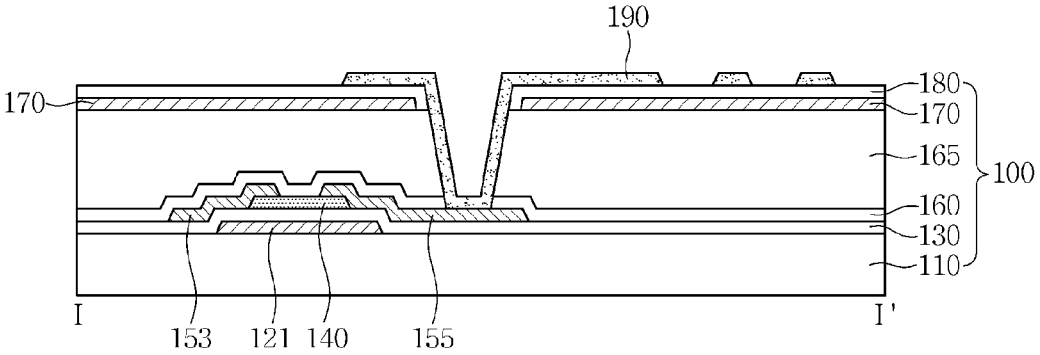

FIG. 1 is a block diagram illustrating an exemplary embodiment of a display device, FIG. 2 is a plan view illustrating an exemplary embodiment of a display device, FIG. 3 is a cross-sectional view taken along line I-I' of FIG. 2, FIGS. 4A, 4B, 4C, 4D, and 4E are plan views illustrating a method of manufacturing an exemplary embodiment of a display device, and FIGS. 5A, 5B, 5C, 5D, and 5E are cross-sectional views illustrating the method of manufacturing an exemplary embodiment of a display device.

Hereinafter, an exemplary embodiment is described under the assumption that a display device is a liquid crystal display ("LCD") device in a plane to line switching ("PLS") mode, but the scope of the present invention is not limited thereto, and exemplary embodiments may be applied to a display device in a TN mode, a VA mode, or an IPS mode, and also to an organic light emitting diode ("OLED") display device.

Referring to FIGS. 1, 2, 3, 4, 5A, 5B, 5C, 5D, and 5E, an exemplary embodiment of a display device includes a display substrate 100, an opposing substrate 200, a liquid crystal layer 300 between the display substrate 100 and the opposing substrate 200, a gate driver 400, a data driver 500, a signal control unit 600, and a gray-level voltage generator 700. In addition, an exemplary embodiment of a display device may further include a backlight unit (not illustrated) which provides light toward the display substrate 100.

The display substrate 100 includes a first substrate 110, gate wiring $G_1$ to $G_m$ and 121, a first insulating layer 130, a semiconductor layer 140, data wiring $D_1$ to $D_n$ and 153 and 155, a second insulating layer 160, an organic layer 165, a first electric-field generating electrode 170, a third insulating layer 180, and a second electric-field generating electrode 190.

The first substrate 110 may be an insulating substrate, such as a plastic substrate, which has light transmitting characteristics and flexibility. However, exemplary embodiments are not limited thereto, and the first substrate 110 may include a hard substrate such as a glass substrate.

The gate wiring $G_1$ to $G_m$ and 121 includes gate lines $G_1$ to $G_m$ extending in a row direction and disposed parallel to one another and a gate electrode 121 protruding from each of the gate lines $G_1$ to $G_m$.

The gate wiring $G_1$ to $G_m$ and 121 may include or consist of aluminum (Al) or alloys thereof, silver (Ag) or alloys thereof, copper (Cu) or alloys thereof, molybdenum (Mo) or alloys thereof, chromium (Cr), tantalum (Ta), titanium (Ti), and/or the like.

In addition, the gate wiring $G_1$ to $G_m$ and 121 may have a multilayer structure including two or more conductive layers (not illustrated) having different physical properties. For example, one conductive layer of the multilayer structure may include or consist of a metal having low resistivity to reduce signal delay or voltage drop, e.g., an aluminum (Al)-based metal, a silver (Ag)-based metal, and a copper (Cu)-based metal, and another conductive layer of the multilayer structure may include a material that is found to impart an excellent contact property with indium tin oxide (ITO) and indium zinc oxide (IZO), e.g., a molybdenum-based metal, chromium, titanium, tantalum, and the like.

Examples of the multilayer structure may include a chromium lower layer and an aluminum upper layer, an aluminum lower layer and a molybdenum upper layer, and a titanium lower layer and a copper upper layer. However, exemplary embodiments are not limited thereto, and the gate wiring $G_1$ to $G_m$ and 121 may include various kinds of metals and conductors.

The first insulating layer 130 is disposed on the first substrate 110 on which the gate wiring $G_1$ to $G_m$ and 121 is disposed. The first insulating layer 130 may include silicon oxide ($SiO_x$) or silicon nitride ($SiN_x$). In addition, the first insulating layer 130 may further include aluminum oxide, titanium oxide, tantalum oxide, or zirconium oxide.

The semiconductor layer 140 is disposed on the first insulating layer 130. The semiconductor layer 140 may substantially overlap the gate electrode 121. The semiconductor layer 140 may be an a-si semiconductor, a poly-si semiconductor, or an oxide semiconductor.

The data wiring $D_1$ to $D_n$ and 153 and 155 is disposed on the semiconductor layer 140.

The data wiring $D_1$ to $D_n$ and 153 and 155 includes data lines $D_1$ to $D_n$ extending in a column direction and disposed parallel to one another, a source electrode 153 branching off from each of the data lines $D_1$ to $D_n$, and a drain electrode 155 spaced apart from the source electrode 153. The source electrode 153 and the drain electrode 155, along with the gate electrode 121, define three terminals of a thin film transistor ("TFT"). The data wiring $D_1$ to $D_n$ and 153 and 155 may include a same material as that included in the gate wiring $G_1$ to $G_m$ and 121.

The second insulating layer 160 is disposed on the first substrate 110 on which the data wiring $D_1$ to $D_n$ and 153 and 155 is disposed. The second insulating layer 160 may include silicon oxide ($SiO_x$) or silicon nitride ($SiN_x$). In addition, the second insulating layer 160 may further include aluminum oxide, titanium oxide, tantalum oxide, or zirconium oxide.

The organic layer 165 is disposed on the second insulating layer 160. The organic layer 165 may have a thickness ranging from about 1.0 μm to about 3.5 μm.

The first electric-field generating electrode 170 is disposed on the organic layer 165. The first electric-field generating electrode 170 may be a planar electrode. In addition, the first electric-field generating electrode 170 may include a transparent conductor such as indium tin oxide (ITO) or indium zinc oxide (IZO).

The third insulating layer 180 is disposed on the first substrate 110 on which the first electric-field generating electrode 170 is disposed. The third insulating layer 180 may include silicon oxide ($SiO_x$) or silicon nitride ($SiN_x$). In addition, the third insulating layer 180 may further include aluminum oxide, titanium oxide, tantalum oxide, or zirconium oxide.

The second electric-field generating electrode 190 is disposed on the third insulating layer 180 to overlap the first electric-field generating electrode 170. An exemplary embodiment of the second electric-field generating electrode 190 may have a structure including a stem portion and branch portions diagonally extending from the stem portion, and may include a transparent conductor such as indium tin oxide (ITO) or indium zinc oxide (IZO).

The opposing substrate 200 includes a second substrate 210, a color filter 220, a light blocking layer 230, and an overcoat layer 240, for example.

The second substrate 210 may be an insulating substrate including plastic or transparent glass such as soda lime glass or borosilicate glass, for example.

The color filter 220 and the light blocking layer 230 are disposed on the second substrate 210.

The color filter 220 may be one selected from: a red color filter, a green color filter, a blue color filter, a cyan color filter, a magenta color filter, a yellow color filter, and a white color filter. Three primary colors of red, green, and blue, or cyan, magenta, and yellow may define a basic pixel group for representing a color.

The light blocking layer 230 defines an aperture area through which light is transmitted. The light blocking layer 230 is also referred to as a black matrix, and defines a pixel area. The light blocking layer 230 may include a metal such as chrome oxide ($CrO_x$) or an opaque organic layer material.

The overcoat layer 240 is disposed on the color filter 220 and the light blocking layer 230. The overcoat layer 240 planarizes an uneven surface of a layer therebelow, e.g., the color filter 220 and the light blocking layer 230, and efficiently suppresses or prevents exudation of undesired materials from the layer therebelow.

The gate driver 400 is connected to the gate lines $G_1$ to $G_m$ to transmit to the gate liens $G_1$ to $G_m$ a gate signal which consists of a gate-on voltage Von and a gate-off voltage Voff.

The data driver 500 is connected to the data lines $D_1$ to $D_n$, and selects a gray level voltage applied from the gray-level voltage generator 700 to transmit to the data lines $D_1$ to $D_n$ the selected gray level voltage as a data signal.

The signal control unit 600 controls the gate driver 400 and the data driver 500. The signal control unit 600 receives from an external graphic controller (not illustrated) an input image signal R, G, and B and an input control signal which controls representation of the input image signal R, G, and B. Examples of the input control signal may include a vertical synchronization signal Vsync, a horizontal synchronization signal Hsync, a main clock MCLK, and a data enable signal DE.

The signal control unit 600 suitably treats the input image signal R, G, and B based on the input image signal R, G, and B and the input control signal according to operational conditions, generates a gate control signal CONT1 and a data control signal CONT2, transmits the gate control signal CONT1 to the gate driver 400, and transmits the data control signal CONT2 and a treated digital image signal DAT to the data driver 500.

Each of the driving devices 400, 500, 600, and 700 may be directly disposed (e.g., embedded) as at least one integrated circuit chip in the first substrate 110, disposed (e.g., embedded) on a flexible printed circuit film (not illustrated) to be attached to the first substrate 110 as a tape carrier package (TCP), or disposed (e.g., embedded) on a separate printed circuit board ("PCB," not illustrated).

Figure 6:
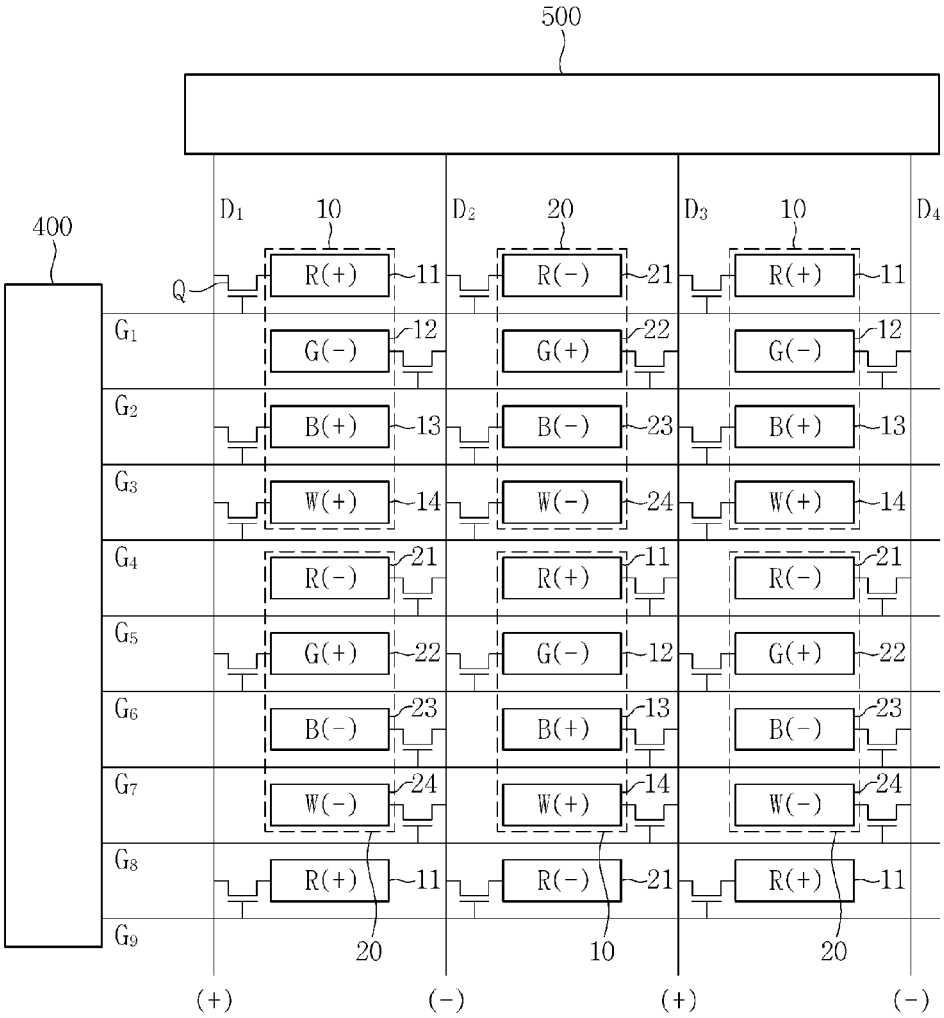
FIG. 6 is a view illustrating polarity application in an exemplary embodiment of a display device.
Figure 7A:
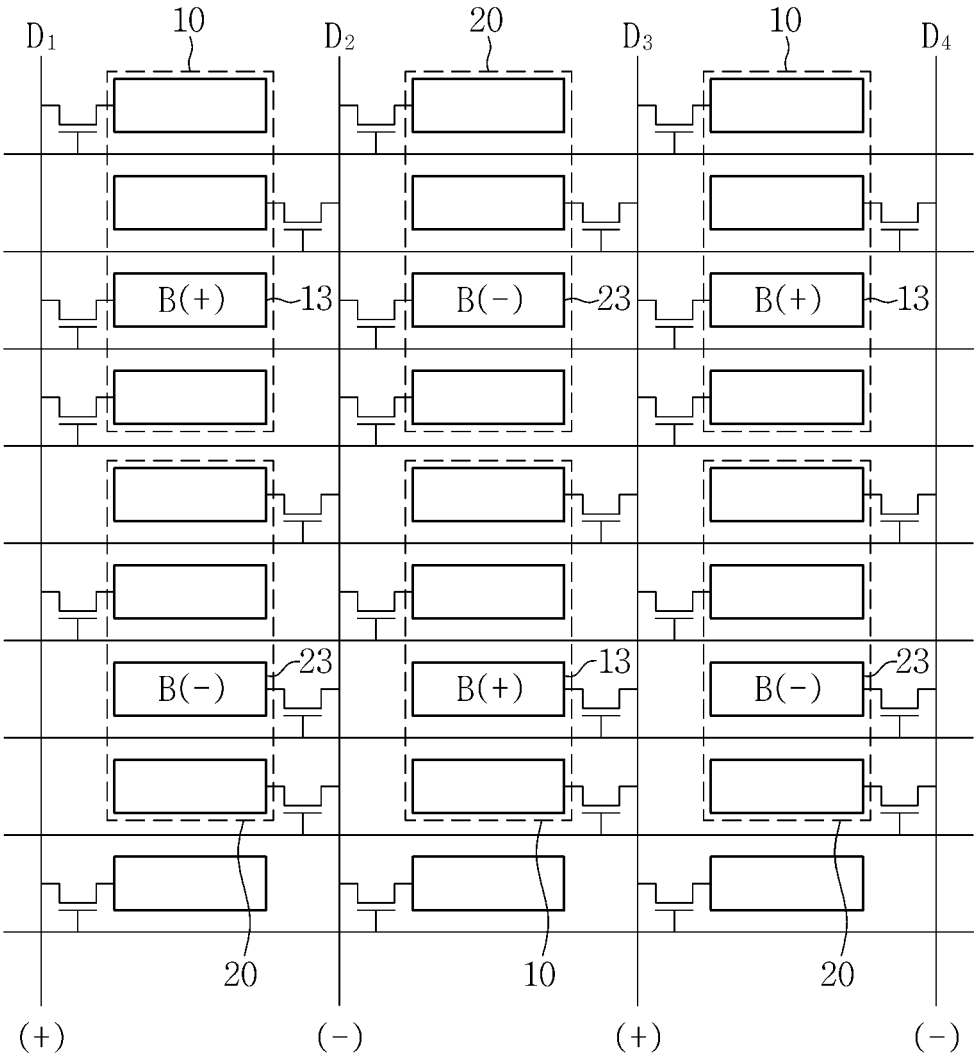
FIG. 7A, FIG. 7B, FIG. 7C, FIG. 7D, FIG. 7E, FIG. 7F, FIG. 7G, and FIG. 7H are views illustrating polarity application for each color of an exemplary embodiment of a display device.
Figure 7B:
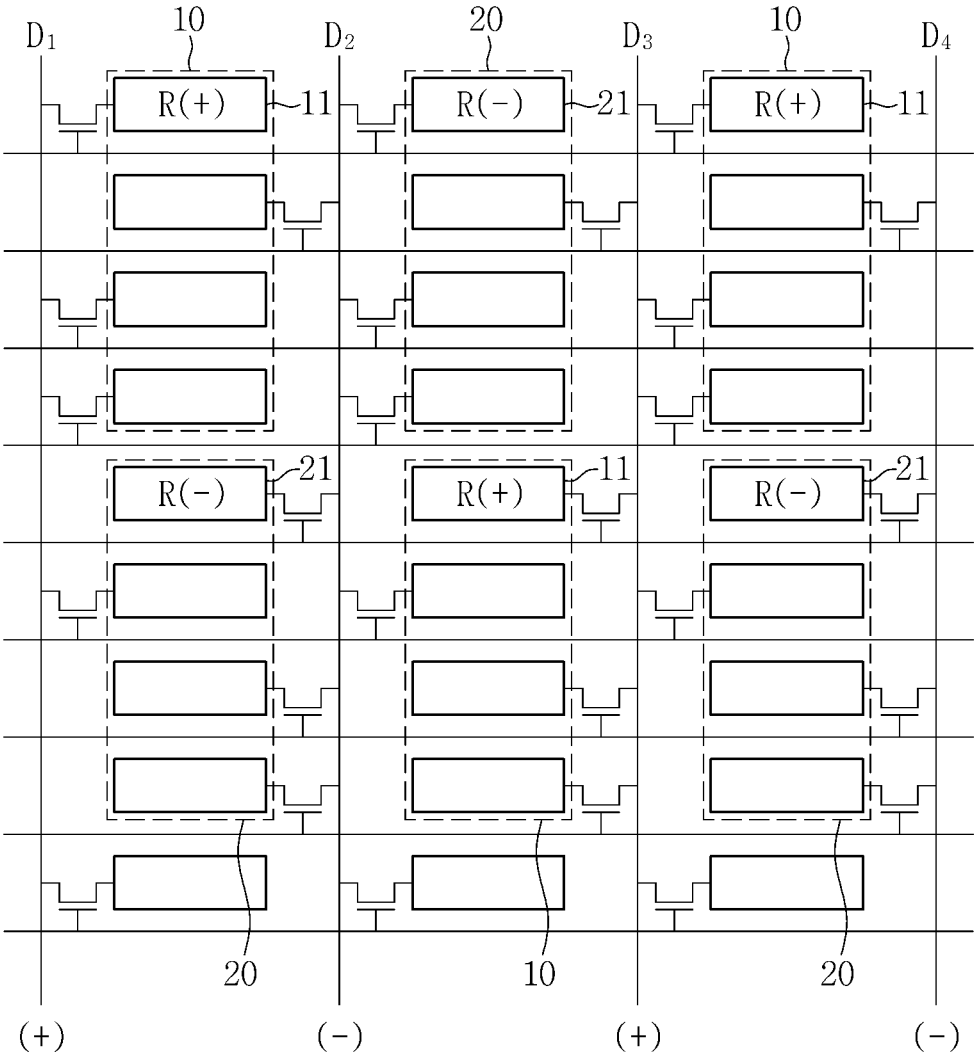
Figure 7C:
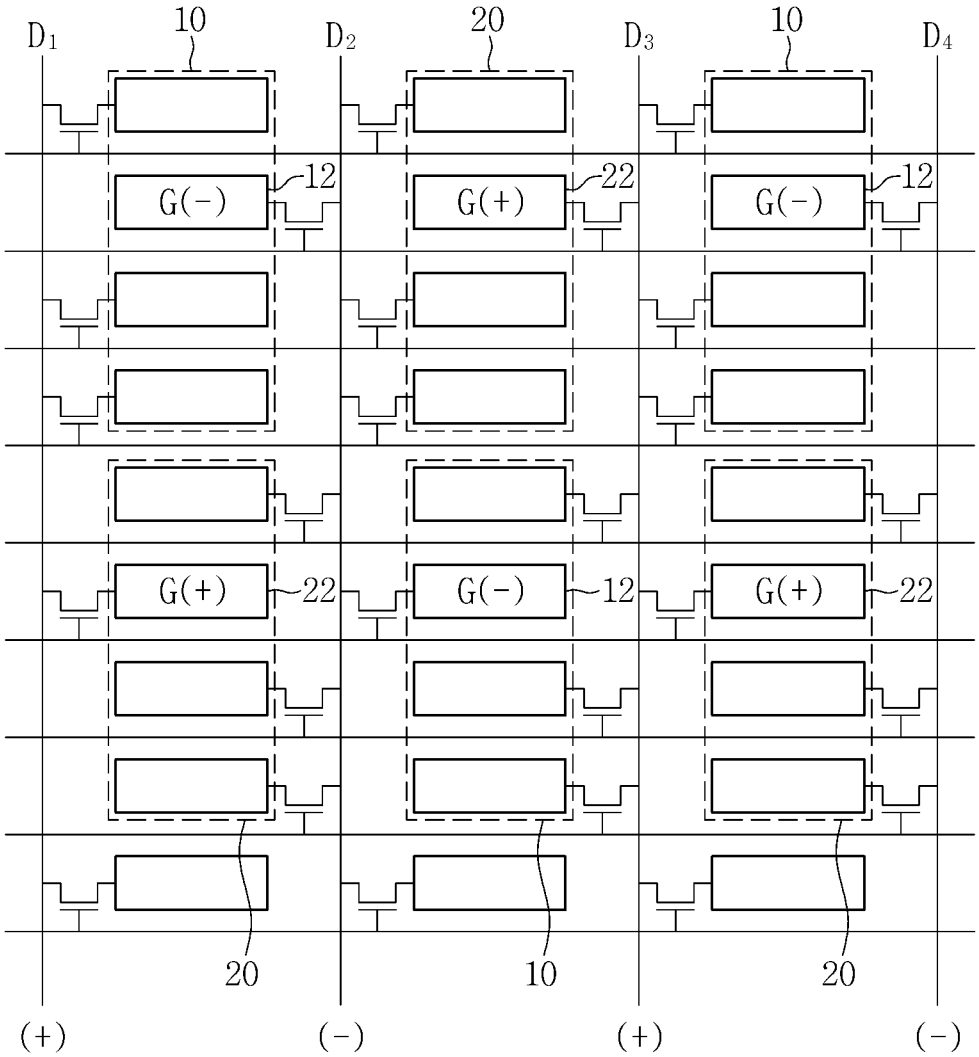
Figure 7D:
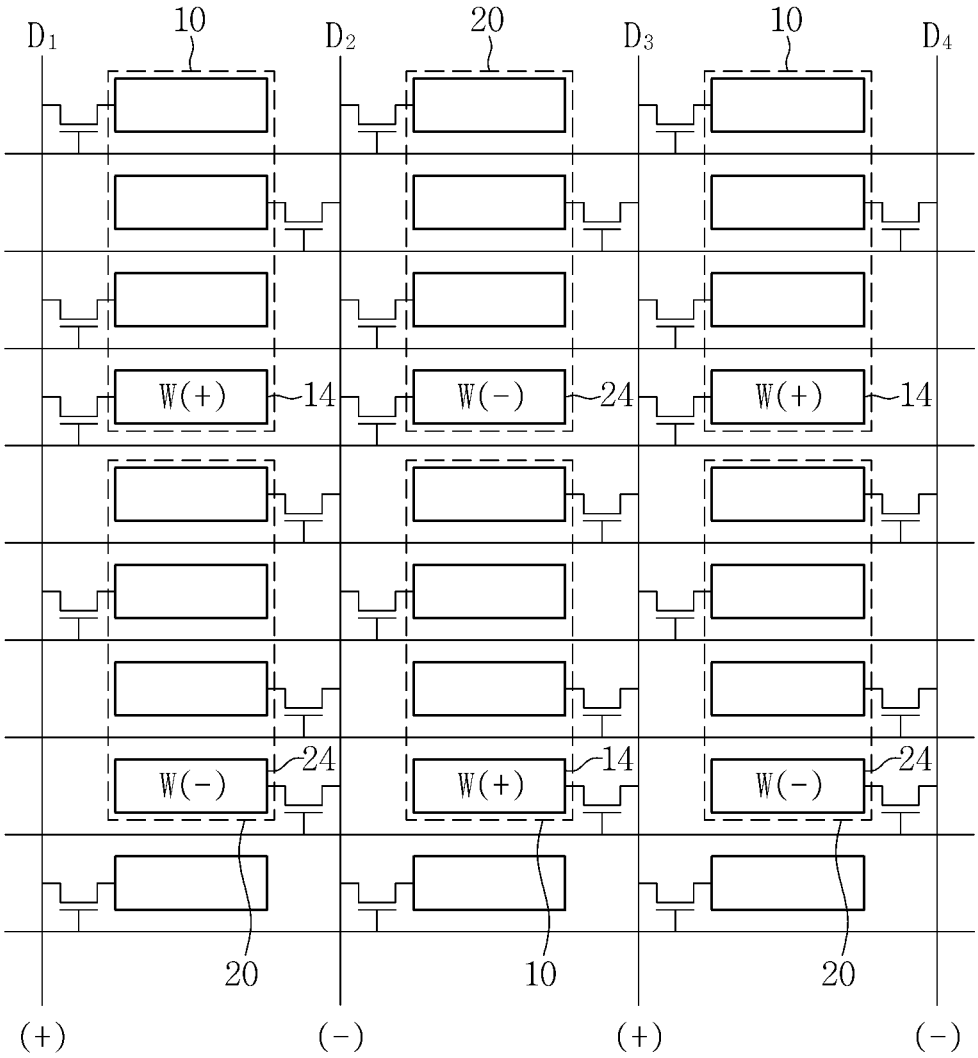
Figure 7E:
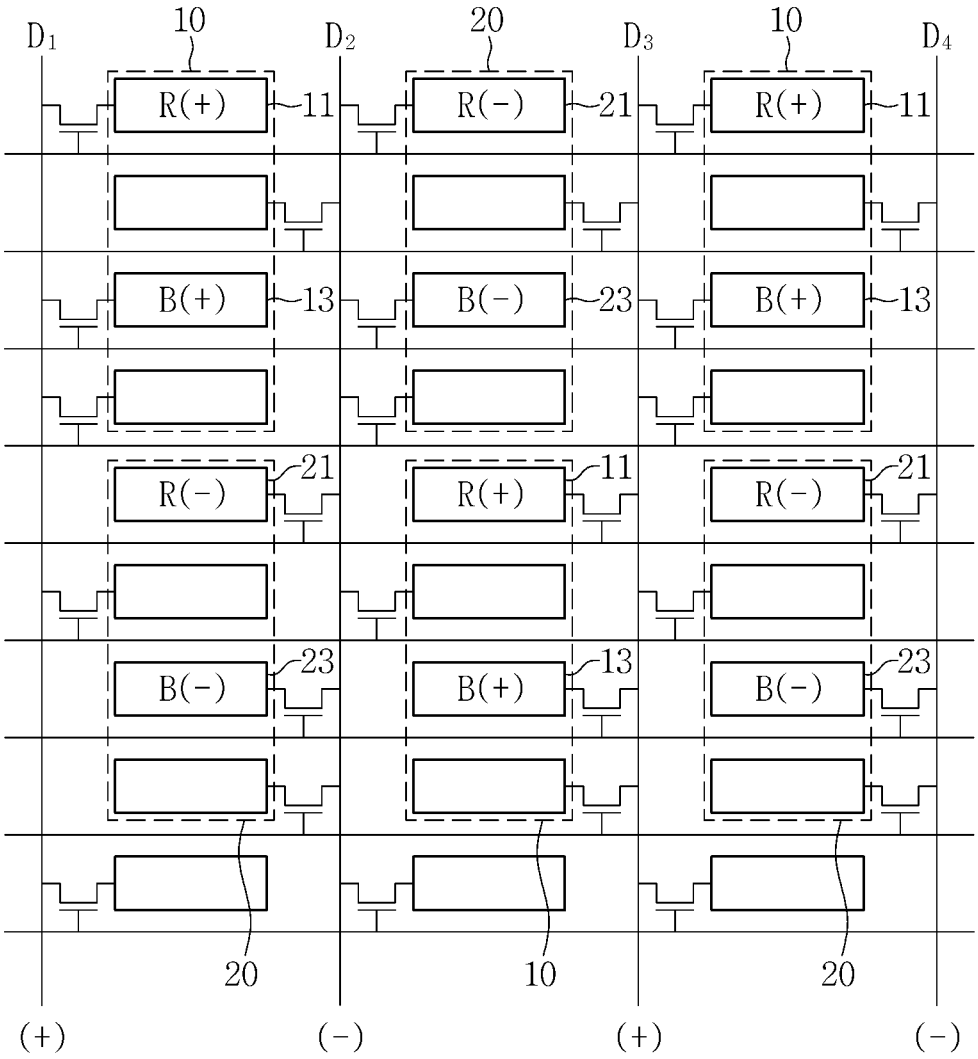
Figure 7F:
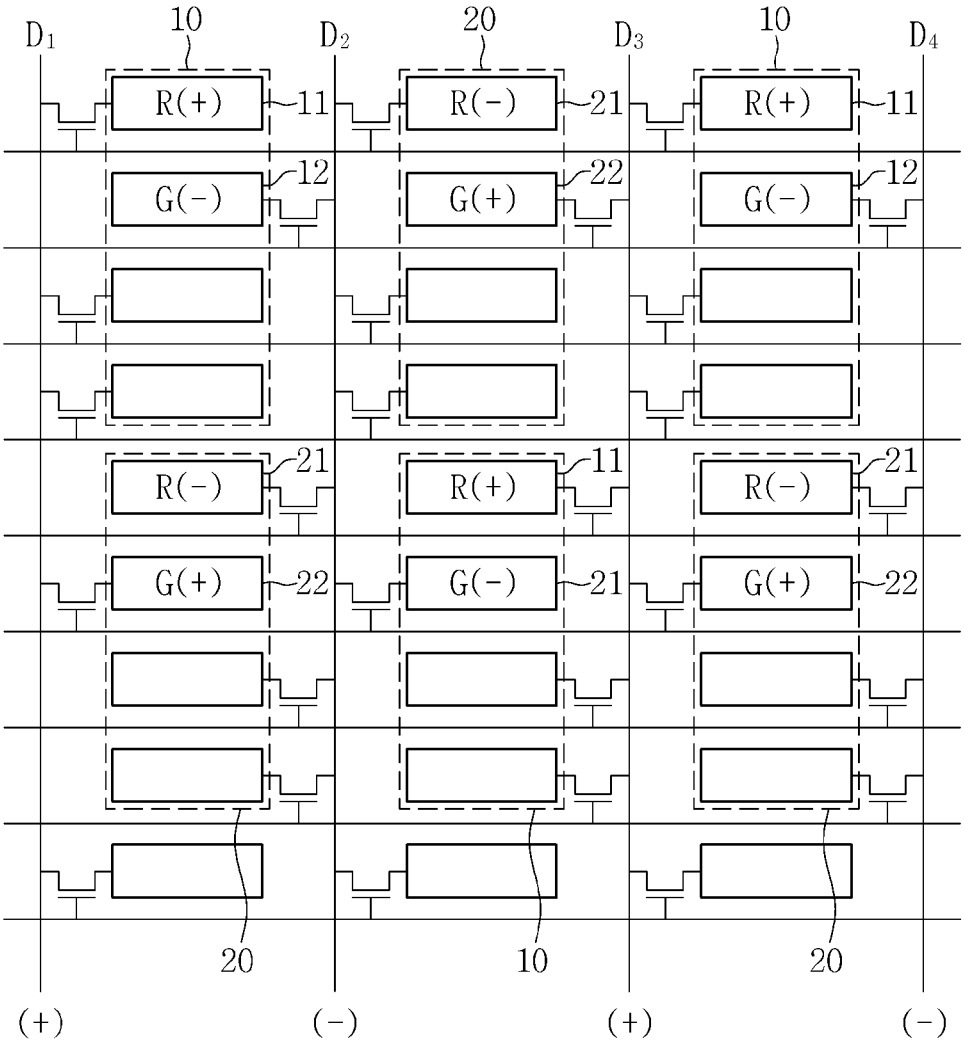
Figure 7G:
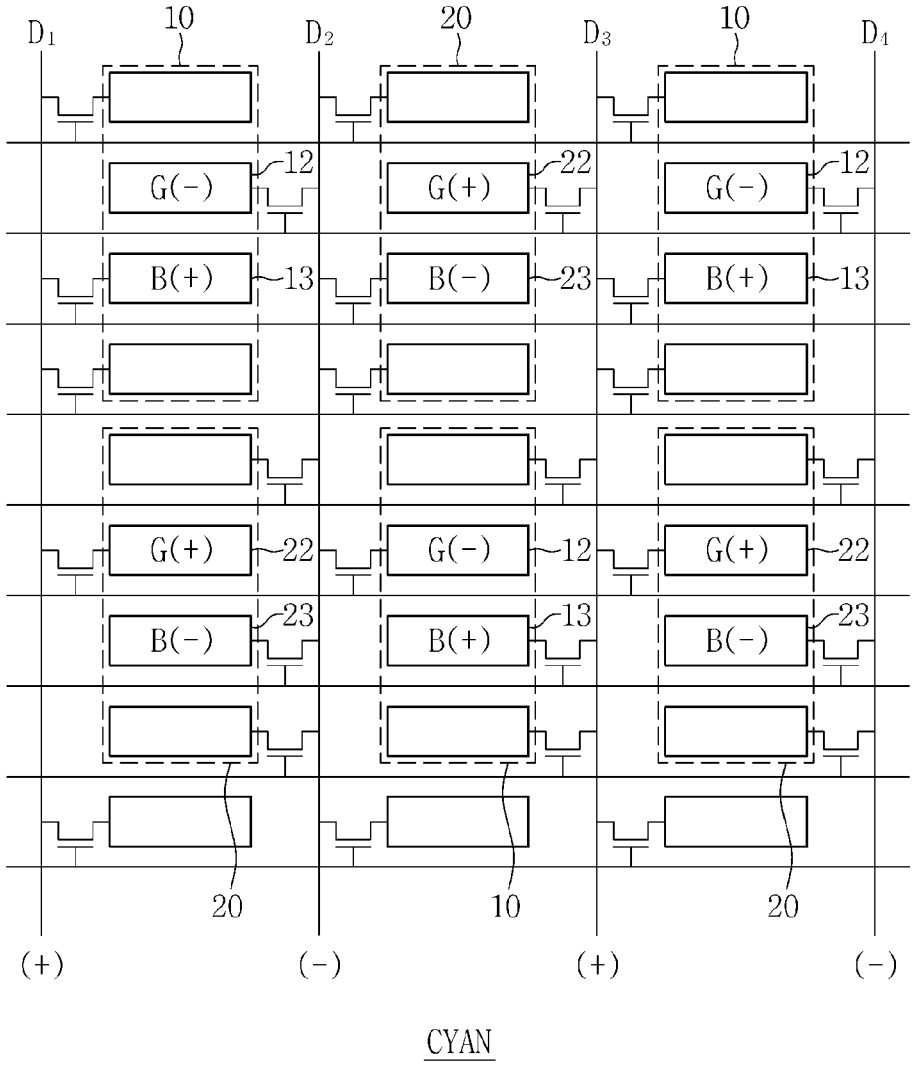
Figure 7H:
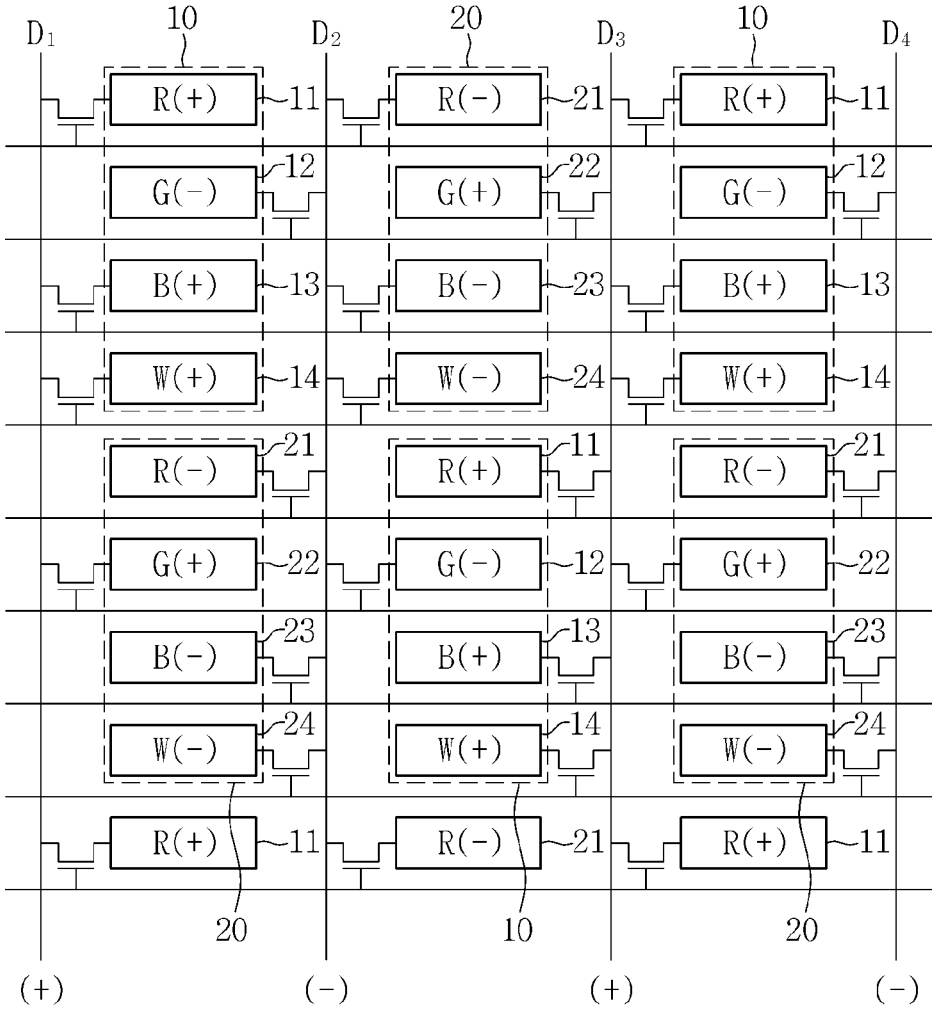
Figure 8:
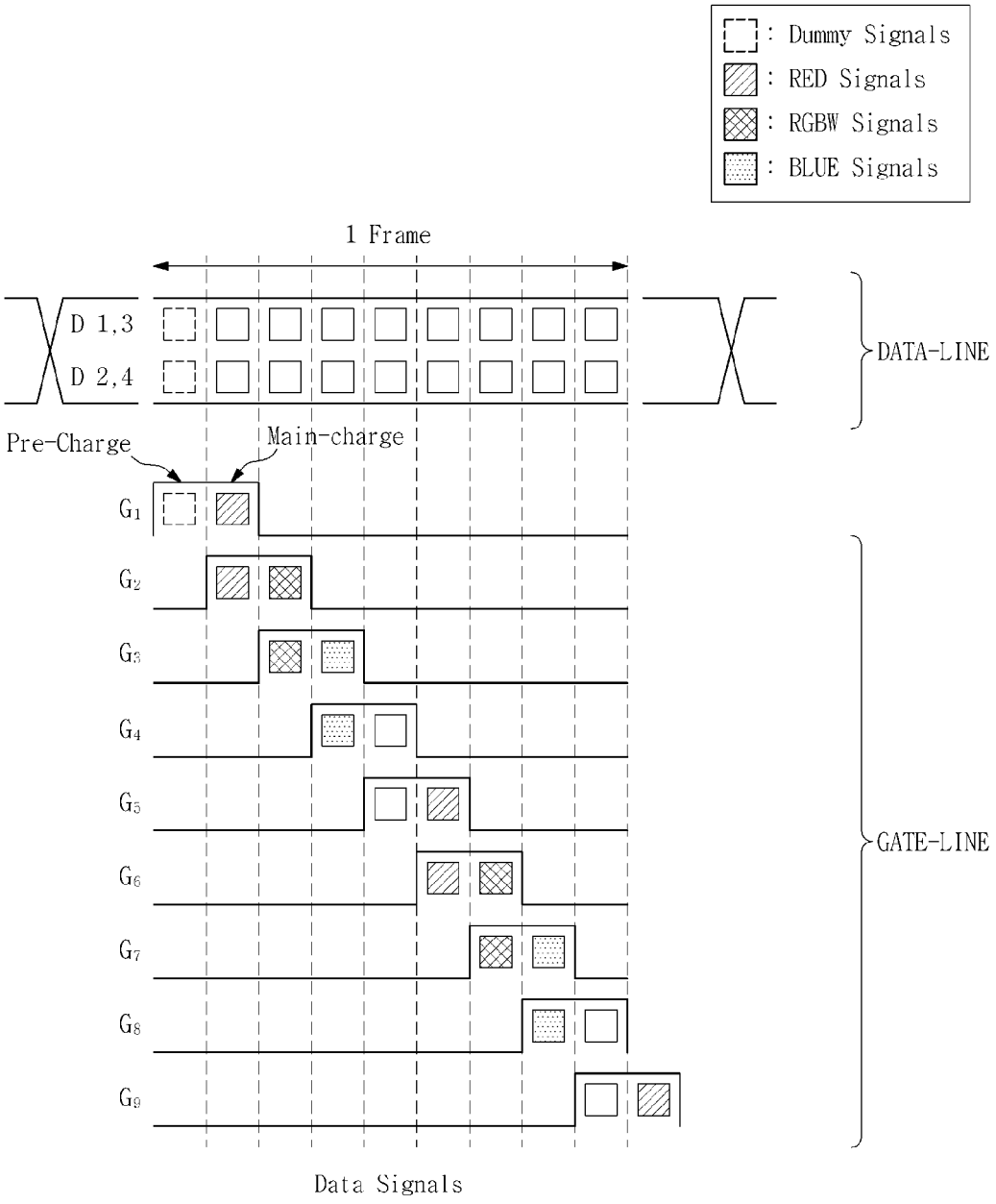
FIG. 8 is a driving timing diagram of an exemplary embodiment of a display device.

FIG. 6 is a view illustrating polarity application in an exemplary embodiment of a display device, FIGS. 7A, 7B, 7C, 7D, 7E, 7F, 7G, and 7H are views illustrating polarity application for each color of an exemplary embodiment of a display device, and FIG. 8 is a driving timing diagram of an exemplary embodiment of a display device.

FIGS. 6, 7, and 8 illustrate nine gate lines $G_1$, $G_2$, $G_3$, $G_4$, $G_5$, $G_6$, $G_7$, $G_8$, and $G_9$ and four data lines $D_1$, $D_2$, $D_3$, and $D_4$, for ease of description. In addition, for ease of description, odd-numbered data lines $D_1$ and $D_3$ are referred to as a first data line $D_1$ and $D_3$, and even-numbered data lines $D_2$ and $D_4$ are referred to as a second data line $D_2$ and $D_4$. That is, the first data line D1 and D3 and the second data line D2 and D4 are alternately disposed along a row direction.

Referring to FIG. 6, a first pixel group 10 including first, second, third, and fourth pixels 11, 12, 13, and 14 arranged along a column direction and a second pixel group 20 including fifth, sixth, seventh, and eighth pixels 21, 22, 23, and 24 arranged along a column direction are provided. The first pixel group 10 and the second pixel group 20 are arranged in a matrix form.

The first, second, third, fourth, fifth, sixth, seventh, and eighth pixels 11, 12, 13, 14, 21, 22, 23, and 24 are connected to the gate lines $G_1$, $G_2$, $G_3$, $G_4$, $G_5$, $G_6$, $G_7$, $G_8$, and $G_9$ and the data lines $D_1$, $D_2$, $D_3$, and $D_4$, using a switching element Q.

For example, each of the first, second, third, fourth, fifth, sixth, seventh, and eighth pixels 11, 12, 13, 14, 21, 22, 23, and 24 is connected to the gate lines $G_1$, $G_2$, $G_3$, $G_4$, $G_5$, $G_6$, $G_7$, $G_8$, and $G_9$. The first pixel 11, the third pixel 13, the fourth pixel 14, and the sixth pixel 22 are connected to the first data line $D_1$ and D3, and the second pixel 12, the fifth pixel 21, the seventh pixel 23, and the eighth pixel 24 are connected to the second data lien $D_2$ and $D_4$.

The data driver 500 applies voltages having different polarities to the first data line $D_1$ and $D_3$ and the second data line $D_2$ and $D_4$, respectively. For example, the data driver 500 may apply a positive (+) voltage to the first data line $D_1$ and $D_3$, and apply a negative (−) voltage to the second data line $D_2$ and $D_4$. In an alternative exemplary embodiment, the data driver 500 may apply a negative (−) voltage to the first data line $D_1$ and $D_3$, and apply a positive (+) voltage to the second data line $D_2$ and $D_4$.

The first, second, third, and fourth pixels 11, 12, 13, and 14 may have different colors from one another, for example, red, green, blue, and white colors, respectively. In an alternative exemplary embodiment, the first, second, third, and fourth pixels 11, 12, 13, and 14 may have various colors, e.g., magenta, cyan, and yellow colors.

Similarly, the fifth, sixth, seventh, and eighth pixels 21, 22, 23, and 24 may have different colors from one another, for example, red, green, blue, and white colors, respectively. In an alternative exemplary embodiment, the fifth, sixth, seventh, and eighth pixels 21, 22, 23, and 24 may have various colors, e.g., magenta, cyan, and yellow colors.

As the first pixel group 10 and the second pixel group 20, and the first data line $D_1$ and $D_3$ and the second data line $D_2$ and $D_4$ have a relationship in the above-described manner, the line flickering may be improved, which will be described in detail with reference to FIGS. 7A, 7B, 7C, 7D, 7E, 7F, 7G, and 7H.

Referring to FIG. 7A, in order to represent a blue color, data voltages having different polarities are respectively applied to the third pixel 13 and the seventh pixel 23, which are adjacent to each other. That is, a phenomenon that conventionally causes line flickering, in which a data voltage of a same polarity is applied to pixels having a same color in a column direction, may be reduced. That is, as pixels having a same color in a column direction have different polarities from one another, the severity of line flickering may be reduced.

In addition, referring to FIG. 7B, in order to represent a red color, data voltages having different polarities are respectively applied to the first pixel 11 and the fifth pixel 21, which are adjacent to each other.

In addition, referring to FIG. 7C, in order to represent a green color, data voltages having different polarities are respectively applied to the second pixel 12 and the sixth pixel 22, which are adjacent to each other.

In addition, referring to FIG. 7D, in order to represent a white color, data voltages having different polarities are respectively applied to the fourth pixel 14 and the eighth pixel 24, which are adjacent to each other.

In addition, referring to FIG. 7E, in order to represent a magenta color, data voltages having different polarities are respectively applied to the first pixel 11 and the fifth pixel 21, which are adjacent to each other, and data voltages having different polarities are respectively applied to the third pixel 13 and the seventh pixel 23, which are adjacent to each other.

In addition, referring to FIG. 7F, in order to represent a yellow color, data voltages having different polarities are respectively applied to the first pixel 11 and the fifth pixel 21, which are adjacent to each other, and data voltages having different polarities are respectively applied to the second pixel 12 and the sixth pixel 22, which are adjacent to each other.

In addition, referring to FIG. 7G, in order to represent a cyan color, data voltages having different polarities are respectively applied to the second pixel 12 and the sixth pixel 22, which are adjacent to each other, and data voltages having different polarities are respectively applied to the third pixel 13 and the seventh pixel 23, which are adjacent to each other.

In addition, referring to FIG. 7H, in order to represent a white color, data voltages having different polarities are respectively applied to the first, second, third, and fourth pixels 11, 12, 13, and 14, and the fifth, sixth, seventh, and eighth pixels 21, 22, 23, and 24, which are adjacent to each other.

In such an exemplary embodiment, the line flickering phenomenon may be reduced while all colors may be represented.

In an exemplary embodiment, referring to FIG. 8, a pre-charge time may further be added in a driving, in addition to a main charge time. That is, the gate lines $G_1$, $G_2$, $G_3$, $G_4$, $G_5$, $G_6$, $G_7$, $G_8$, and $G_9$ being provided in each row may lead to a decrease of a storage ratio, and the pre-charge time may further be added to enhance the storage ratio. The pre-charge time may be about ½ of a maximum main charge time or less.

It is obvious that such a driving timing diagram may not be applied. The driving timing diagram illustrated in FIG. 8 is a driving method that may further be employed regardless of addressing the issue of line flickering.

Figure 9:
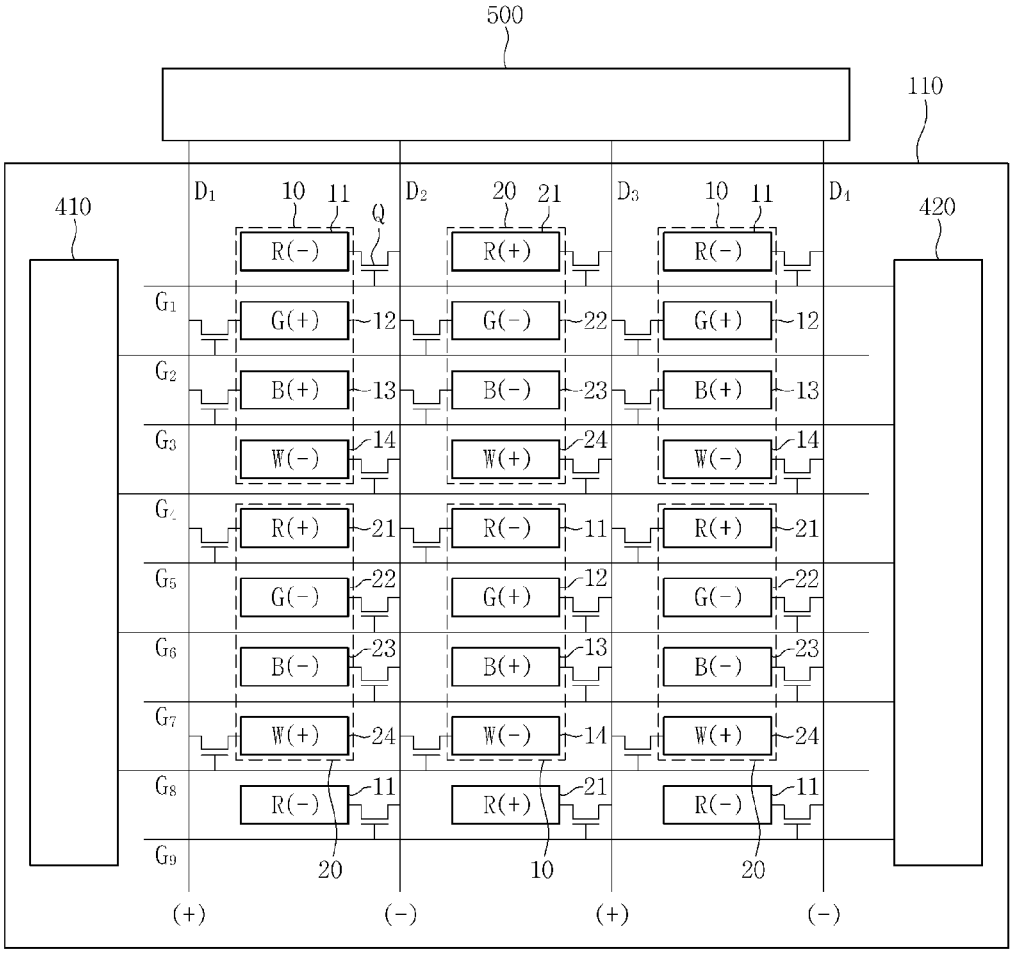
FIG. 9 is a view illustrating polarity application in another exemplary embodiment of a display device.

FIG. 9 is a view illustrating polarity application in another exemplary embodiment of a display device. For ease of description, descriptions pertaining to the same configurations as those described above will be omitted. FIG. 9 illustrates nine gate lines $G_1$, $G_2$, $G_3$, $G_4$, $G_5$, $G_6$, $G_7$, $G_8$, and $G_9$ and four data lines $D_1$, $D_2$, $D_3$, and $D_4$, for ease of description. In addition, for ease of description, odd-numbered data lines $D_1$ and $D_3$ are referred to as a first data line $D_1$ and $D_3$, and even-numbered data lines $D_2$ and $D_4$ are referred to as a second data line $D_2$ and $D_4$. That is, the first data line D1 and D3 and the second data line D2 and D4 are alternately disposed along a row direction.

Referring to FIG. 9, a first pixel group 10 including first, second, third, and fourth pixels 11, 12, 13, and 14 arranged along a column direction and a second pixel group 20 including fifth, sixth, seventh, and eighth pixels 21, 22, 23, and 24 arranged along a column direction are provided. The first pixel group 10 and the second pixel group 20 are arranged in a matrix form.

The first, second, third, fourth, fifth, sixth, seventh, and eighth pixels 11, 12, 13, 14, 21, 22, 23, and 24 are connected to the gate lines $G_1$, $G_2$, $G_3$, $G_4$, $G_5$, $G_6$, $G_7$, $G_8$, and $G_9$ and the data lines $D_1$, $D_2$, $D_3$, and $D_4$, using a switching element Q.

For example, each of the first, second, third, fourth, fifth, sixth, seventh, and eighth pixels 11, 12, 13, 14, 21, 22, 23, and 24 is connected to the gate lines $G_1$, $G_2$, $G_3$, $G_4$, $G_5$, $G_6$, $G_7$, $G_8$, and $G_9$. The second pixel 12, the third pixel 13, the fifth pixel 21, and the eighth pixel 24 are connected to the first data line $D_1$ and D3, and the first pixel 11, the fourth pixel 14, the sixth pixel 22, and the seventh pixel 23 are connected to the second data lien $D_2$ and $D_4$.

Unlike the exemplary embodiment described above, the present exemplary embodiment of a display device may include a first gate driver 410 and a second gate driver 420. For example, the first gate driver 410 may be disposed on a side (a left side) of the first substrate 110, and the second gate driver 420 may be disposed on another side (a right side) of the first substrate 110.

In FIG. 9, although the exemplary embodiment of the first gate driver 410 is depicted as being connected to even-numbered gate lines $G_2$, $G_4$, $G_6$, and $G_8$, and the second gate driver 420 is depicted as being connected to odd-numbered gate lines $G_1$, $G_3$, $G_5$, $G_7$, and $G_9$, but exemplary embodiments are not limited thereto. In an alternative exemplary embodiment, the first gate driver 410 may be connected to the odd-numbered gate lines $G_1$, $G_3$, $G_5$, $G_7$, and $G_9$, and the second gate driver 420 may be connected to the even-numbered gate lines $G_2$, $G_4$, $G_6$, and $G_8$. In an exemplary embodiment, the gate drivers 410 and 420 may be provided as a single gate driver as in exemplary embodiments of a display device described above.

The data driver 500 applies voltages having different polarities to the first data line $D_1$ and $D_3$ and the second data line $D_2$ and $D_4$, respectively. For example, the data driver 500 may apply a positive (+) voltage to the first data line $D_1$ and $D_3$, and apply a negative (−) voltage to the second data line $D_2$ and $D_4$. In an alternative exemplary embodiment, the data driver 500 may apply a negative (−) voltage to the first data line $D_1$ and $D_3$, and apply a positive (+) voltage to the second data line $D_2$ and $D_4$.

The first, second, third, and fourth pixels 11, 12, 13, and 14 may have different colors from one another, for example, red, green, blue, and white colors, respectively. In an alternative exemplary embodiment, the first, second, third, and fourth pixels 11, 12, 13, and 14 may have various colors, e.g., magenta, cyan, and yellow colors.

Similarly, the fifth, sixth, seventh, and eighth pixels 21, 22, 23, and 24 may have different colors from one another, for example, red, green, blue, and white colors, respectively. In an alternative exemplary embodiment, the fifth, sixth, seventh, and eighth pixels 21, 22, 23, and 24 may have various colors, e.g., magenta, cyan, and yellow colors.

As the first pixel group 10 and the second pixel group 20, and the first data line $D_1$ and $D_3$ and the second data line $D_2$ and $D_4$ have a relationship in the above-described manner, the line flickering may be improved.

Figure 10:
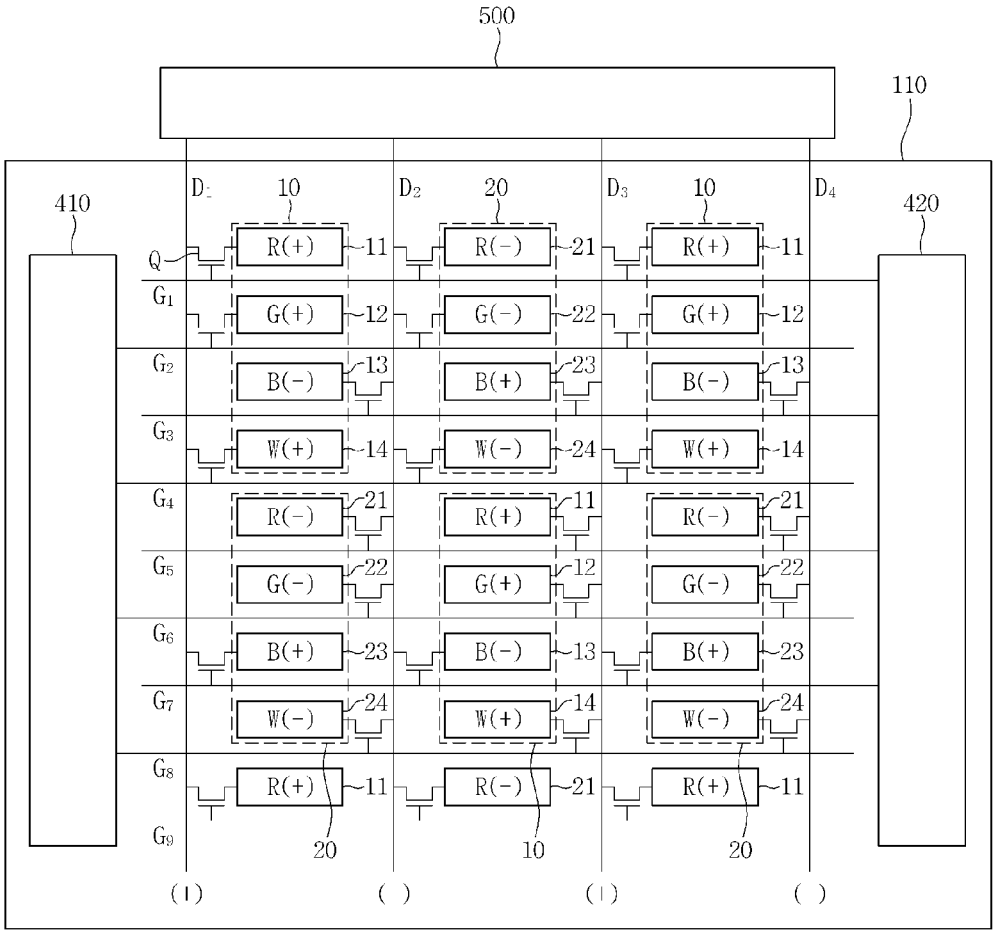
FIG. 10 is a view illustrating polarity application in yet another exemplary embodiment of a display device.

FIG. 10 is a view illustrating polarity application in yet another exemplary embodiment of a display device. For ease of description, descriptions pertaining to the same configurations as those of other exemplary embodiments will be omitted. FIG. 10 illustrates nine gate lines $G_1$, $G_2$, $G_3$, $G_4$, $G_5$, $G_6$, $G_7$, $G_8$, and $G_9$ and four data lines $D_1$, $D_2$, $D_3$, and $D_4$, for ease of description. In addition, for ease of description, odd-numbered data lines $D_1$ and $D_3$ are referred to as a first data line $D_1$ and $D_3$, and even-numbered data lines $D_2$ and $D_4$ are referred to as a second data line $D_2$ and $D_4$. That is, the first data line D1 and D3 and the second data line D2 and D4 are alternately disposed along a row direction.

Referring to FIG. 10, a first pixel group 10 including first, second, third, and fourth pixels 11, 12, 13, and 14 arranged along a column direction and a second pixel group 20 including fifth, sixth, seventh, and eighth pixels 21, 22, 23, and 24 arranged along a column direction are provided. The first pixel group 10 and the second pixel group 20 are arranged in a matrix form.

The first, second, third, fourth, fifth, sixth, seventh, and eighth pixels 11, 12, 13, 14, 21, 22, 23, and 24 are connected to the gate lines $G_1$, $G_2$, $G_3$, $G_4$, $G_5$, $G_6$, $G_7$, $G_8$, and $G_9$ and the data lines $D_1$, $D_2$, $D_3$, and $D_4$, using a switching element Q.

For example, each of the first, second, third, fourth, fifth, sixth, seventh, and eighth pixels 11, 12, 13, 14, 21, 22, 23, and 24 is connected to the gate lines $G_1$, $G_2$, $G_3$, $G_4$, $G_5$, $G_6$, $G_7$, $G_8$, and $G_9$. The first pixel 11, the second pixel 12, the fourth pixel 14, and the seventh pixel 23 are connected to the first data line $D_1$ and $D_3$, and the third pixel 13, the fifth pixel 21, the sixth pixel 22, and the eighth pixel 24 are connected to the second data lien $D_2$ and $D_4$.

Unlike other exemplary embodiments, the present exemplary embodiment of a display device may include a first gate driver 410 and a second gate driver 420. For example, the first gate driver 410 may be disposed on a side (a left side) of the first substrate 110, and the second gate driver 420 may be disposed on another side (a right side) of the first substrate 110.

In FIG. 10, although the present exemplary embodiment of the first gate driver 410 is depicted as being connected to even-numbered gate lines $G_2$, $G_4$, $G_6$, and $G_8$, and the second gate driver 420 is depicted as being connected to odd-numbered gate lines $G_1$, $G_3$, $G_5$, $G_7$, and $G_9$, but exemplary embodiments are not limited thereto. In an alternative exemplary embodiment, the first gate driver 410 may be connected to the odd-numbered gate lines $G_1$, $G_3$, $G_5$, $G_7$, and $G_9$, and the second gate driver 420 may be connected to the even-numbered gate lines $G_2$, $G_4$, $G_6$, and $G_8$. In an exemplary embodiment, the gate drivers 410 and 420 may be provided as a single gate driver as in other exemplary embodiments of a display device described above.

The data driver 500 applies voltages having different polarities to the first data line $D_1$ and $D_3$ and the second data line $D_2$ and $D_4$, respectively. For example, the data driver 500 may apply a positive (+) voltage to the first data line $D_1$ and $D_3$, and apply a negative (−) voltage to the second data line $D_2$ and $D_4$. In an alternative exemplary embodiment, the data driver 500 may apply a negative (−) voltage to the first data line $D_1$ and $D_3$, and apply a positive (+) voltage to the second data line $D_2$ and $D_4$.

The first, second, third, and fourth pixels 11, 12, 13, and 14 may have different colors from one another, for example, red, green, blue, and white colors, respectively. In an alternative exemplary embodiment, the first, second, third, and fourth pixels 11, 12, 13, and 14 may have various colors, e.g., magenta, cyan, and yellow colors.

Similarly, the fifth, sixth, seventh, and eighth pixels 21, 22, 23, and 24 may have different colors from one another, for example, red, green, blue, and white colors, respectively. In an alternative exemplary embodiment, the fifth, sixth, seventh, and eighth pixels 21, 22, 23, and 24 may have various colors, e.g., magenta, cyan, and yellow colors.

As the first pixel group 10 and the second pixel group 20, and the first data line $D_1$ and $D_3$ and the second data line $D_2$ and $D_4$ have a relationship in the above-described manner, the line flickering may be reduced.

As set forth hereinabove, in one or more exemplary embodiments, a display device employs a column inversion driving method such that power consumption may be reduced.

Further, in one or more exemplary embodiments of a display device, line flickering may be significantly reduced such that display quality may be improved.

Although certain exemplary embodiments and implementations have been described herein, other embodiments and modifications will be apparent from this description. Accordingly, the inventive concept is not limited to such embodiments, but rather to the broader scope of the presented claims and various obvious modifications and equivalent arrangements.

What is claimed is:

1. A display device, comprising:

a first pixel group comprising a first pixel, a second pixel, a third pixel, and a fourth pixel arranged along a first direction;

a second pixel group comprising a fifth pixel, a sixth pixel, a seventh pixel, and an eighth pixel arranged along the first direction, the first to eight pixels being linearly arranged along the first direction;

first to eighth gate lines connected to the first to eighth pixels, respectively, the first to eighth gate lines extending along a second direction crossing the first direction;

a first data line connected to the first pixel, the third pixel, the fourth pixel, and the sixth pixel, the first data line extending along the first direction; and a second data line connected to the second pixel, the fifth pixel, the seventh pixel, and the eighth pixel, the second data line extending along the first direction, the second data line being not connected to the first data line, wherein the first pixel group and the second pixel group are alternately disposed along the first direction.

2. The display device as claimed in claim 1, wherein the first to eighth gate lines are disposed along the first direction.

3. The display device as claimed in claim 1, wherein the first data line and the second data line are alternately disposed along the second direction.

4. The display device as claimed in claim 1, wherein the first data line receives a voltage having a different polarity from a polarity of a voltage applied to the second data line.

5. The display device as claimed in claim 4, further comprising a data driver that applies voltages having different polarities to the first data line and the second data line, respectively.

6. The display device as claimed in claim 1, wherein the first, second, third, and fourth pixels receive voltages having different polarities from polarities of voltages applied to the fifth, sixth, seventh, and eighth pixels, respectively.

7. The display device as claimed in claim 1, wherein the first, second, third, and fourth pixels have different colors from one another.

8. The display device as claimed in claim 1, wherein the fifth, sixth, seventh, and eighth pixels have different colors from one another.

9. The display device as claimed in claim 1, wherein the first to eighth pixels are disposed between the first data line and the second data line.

10. The display device as claimed in claim 1, further comprising:

a third pixel group adjacent to the first pixel group in the second direction, the first pixel group and the third pixel group being alternately disposed along the second direction; and a fourth pixel group adjacent to the second pixel group in the second direction, the second pixel group and the fourth pixel group being alternately disposed along the second direction.

11. The display device as claimed in claim 1, wherein first data line is directly connected to respective switching elements of the first pixel, the third pixel, the fourth pixel, and the sixth pixel.

12. The display device as claimed in claim 1, wherein second data line is directly connected to respective switching elements of the second pixel, the fifth pixel, the seventh pixel, and the eighth pixel.

13. A display device, comprising:

a first pixel group comprising a first pixel, a second pixel, a third pixel, and a fourth pixel arranged along a first direction;

a second pixel group comprising a fifth pixel, a sixth pixel, a seventh pixel, and an eighth pixel arranged along the first direction, the first to eight pixels being linearly arranged along the first direction;

first to eighth gate lines connected to the first to eighth pixels, respectively, the first to eighth gate lines extending along a second direction crossing the first direction;

a first data line connected to the second pixel, the third pixel, the fifth pixel, and the eighth pixel, the first data line extending along the first direction; and a second data line connected to the first pixel, the fourth pixel, the sixth pixel, and the seventh pixel, the second data line extending along the first direction, the second data line being not connected to the first data line, wherein the first pixel group and the second pixel group are alternately disposed along the first direction.

14. The display device as claimed in claim 13, wherein the first data line and the second data line are alternately disposed along the second direction.

15. The display device as claimed in claim 13, wherein the first data line receives a voltage having a different polarity from a polarity of a voltage applied to the second data line.

16. The display device as claimed in claim 13, wherein the first, second, third, and fourth pixels receive voltages having different polarities from polarities of voltages applied to the fifth, sixth, seventh, and eighth pixels, respectively.

17. The display device as claimed in claim 13, wherein the first, second, third, and fourth pixels have different colors from one another.

18. The display device as claimed in claim 13, wherein the fifth, sixth, seventh, and eighth pixels have different colors from one another.

19. A display device, comprising:

a first pixel group comprising a first pixel, a second pixel, a third pixel, and a fourth pixel arranged along a first direction;

a second pixel group comprising a fifth pixel, a sixth pixel, a seventh pixel, and an eighth pixel arranged along the first direction, the first to eight pixels being linearly arranged along the first direction;

first to eighth gate lines connected to the first to eighth pixels, respectively, the first to eighth gate lines extending along a second direction crossing the first direction;

a first data line connected to the first pixel, the second pixel, the fourth pixel, and the seventh pixel, the first data line extending along the first direction; and a second data line connected to the third pixel, the fifth pixel, the sixth pixel, and the eighth pixel, the second data line extending along the first direction, the second data line being not connected to the first data line, wherein the first pixel group and the second pixel group are alternately disposed along the first direction.

20. The display device as claimed in claim 19, wherein the first data line and the second data line are alternately disposed along the second direction.

21. The display device as claimed in claim 19, wherein the first data line receives a voltage having a different polarity from a polarity of a voltage applied to the second data line.

22. The display device as claimed in claim 19, wherein the first, second, third, and fourth pixels receive voltages having different polarities from polarities of voltages applied to the fifth, sixth, seventh, and eighth pixels, respectively.

* * * * *